US007787787B2

(12) United States Patent
Yamanaka et al.

(10) Patent No.: US 7,787,787 B2
(45) **Date of Patent: *Aug. 31, 2010**

(54) IMAGE FORMING APPARATUS INCLUDING CONTROLLER DRIVING IMAGE CARRIERS

(75) Inventors: Tetsuo Yamanaka, Tokyo (JP); Kazuhiko Kobayashi, Tokyo (JP); Hiroyasu Shijo, Tokyo (JP); Yuzoh Katsumata, Shizuoka (JP); Mineyo Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/351,549

(22) Filed: Jan. 9, 2009

(65) Prior Publication Data

US 2009/0154947 A1 Jun. 18, 2009

Related U.S. Application Data

(60) Division of application No. 12/061,160, filed on Apr. 2, 2008, now Pat. No. 7,551,867, which is a continuation of application No. 11/542,596, filed on Oct. 4, 2006, now Pat. No. 7,386,259, and a continuation of application No. 10/375,115, filed on Feb. 28, 2003, now Pat. No. 7,136,600.

(30) Foreign Application Priority Data

Feb. 28, 2002 (JP) ..... 2002-052798
Mar. 22, 2002 (JP) ..... 2002-079902

(51) Int. Cl.
*G03G 15/16* (2006.01)

(52) U.S. Cl. ..... 399/66; 399/53; 399/299; 399/302

(58) Field of Classification Search ..... 399/53, 399/223, 66, 299, 302
See application file for complete search history.

(56) References Cited

U.S. PATENT DOCUMENTS

| | | | |
|---|---|---|---|
| 5,365,324 | A | 11/1994 | Gu et al. |
| 5,486,909 | A | 1/1996 | Takenaka et al. |
| 5,489,747 | A | 2/1996 | Takenaka et al. |
| 5,617,191 | A | 4/1997 | Murakami et al. |
| 5,625,440 | A | 4/1997 | Matsumae et al. |
| 5,625,441 | A | 4/1997 | Sugiyama et al. |
| 5,666,625 | A | 9/1997 | Komatsubara et al. |
| 5,689,782 | A | 11/1997 | Murakami et al. |

(Continued)

FOREIGN PATENT DOCUMENTS

| | | |
|---|---|---|
| JP | 62-83623 | 4/1987 |

(Continued)

*Primary Examiner*—David P Porta
*Assistant Examiner*—Bryan P Ready
(74) *Attorney, Agent, or Firm*—Oblon, Spivak, McClelland, Maier & Neustadt, L.L.P.

(57) ABSTRACT

An image forming apparatus of the present invention includes image carriers arranged side by side in a preselected direction, developing means each for forming a toner image on one of the image carriers, a drive mechanism for driving in the preselected direction a member to which toner images are to be sequentially transferred from the image carriers one above the other, and image transferring devices each for transferring a toner image from one of the image carriers to the above member. At east during an image forming process, a slip condition is substantially the same throughout all image transfer positions where the image carriers face the members.

6 Claims, 25 Drawing Sheets

U.S. PATENT DOCUMENTS

| | | | |
|---|---|---|---|
| 5,697,026 | A | 12/1997 | Matsumae et al. |
| 5,717,981 | A | 2/1998 | Yamanaka |
| 5,768,665 | A | 6/1998 | Yamanaka et al. |
| 5,826,144 | A | 10/1998 | Takenaka et al. |
| 5,845,183 | A | 12/1998 | Sugiyama et al. |
| 5,879,752 | A | 3/1999 | Murakami et al. |
| 5,897,243 | A | 4/1999 | Komatsubara et al. |
| 5,930,561 | A | 7/1999 | Hosokawa et al. |
| 5,933,687 | A | 8/1999 | Okuno et al. |
| 6,021,287 | A | 2/2000 | Tanaka |
| 6,033,818 | A | 3/2000 | Sugiyama et al. |
| 6,163,666 | A | 12/2000 | Hosokawa et al. |
| 6,167,221 | A | 12/2000 | Kobayashi |
| 6,212,343 | B1 | 4/2001 | Hosokawa et al. |
| 6,218,660 | B1 | 4/2001 | Hada |
| 6,505,026 | B2 | 1/2003 | Hayakawa et al. |
| 6,567,643 | B2 | 5/2003 | Yasu et al. |
| 6,631,249 | B2 | 10/2003 | Katsumi et al. |

FOREIGN PATENT DOCUMENTS

| | | |
|---|---|---|
| JP | 63-151970 | 6/1988 |
| JP | 8-114963 | 5/1996 |
| JP | 8-123130 | 5/1996 |
| JP | 9-274349 | 10/1997 |
| JP | 10-10885 | 1/1998 |
| JP | 10-221914 | 8/1998 |
| JP | 11-024345 A | 1/1999 |
| JP | 11-174862 | 7/1999 |
| JP | 2000-105507 A | 4/2000 |
| JP | 2001-201902 | 7/2001 |
| JP | 2002-174942 | 6/2002 |

IMAGE FORMING APPARATUS INCLUDING CONTROLLER DRIVING IMAGE CARRIERS

CROSS-REFERENCE TO RELATED APPLICATIONS

This application is a division of application U.S. Ser. No. 12/061,160, filed Apr. 2, 2008, now U.S. Pat. No. 7,551,867, which is a continuation of and claims the benefit of priority under 35 USC §120 from U.S. Ser. No. 11/542,596, filed Oct. 4, 2006, now U.S. Pat. No. 7,386,259, U.S. Ser. No. 10/375,115, filed Feb. 28, 2003, which issued as U.S. Pat. No. 7,136,600, on Nov. 14, 2006, and is based upon and claims the benefit of priority under 35 USC §119 from the Japanese Patent Applications No. 2002-052798, filed Feb. 28, 2002 and No. 2002-079902, filed Mar. 22, 2002, the entire contents of each of which are incorporated herein by reference.

BACKGROUND OF THE INVENTION

1. Field of the Invention

The present invention relates to a facsimile apparatus, printer, copier or similar image forming apparatus and more particularly to a color image forming apparatus constructed to sequentially transfer a magenta (M), a cyan (C), a yellow (Y) and a black (BK) toner image to a sheet or similar recording medium being conveyed by a belt with image transfer members one above the other.

2. Description of the Related Art

Color image forming apparatuses extensively used today include the following three types of apparatuses (1) through (3).

(1) Japanese Patent Laid-Open Publication No. 9-50166, for example, discloses an indirect image transfer type of full-color image forming apparatus including a single photoconductive belt or image carrier and developing units each being assigned to a particular color. More specifically, a first developing unit develops a latent image for a first color formed on the photoconductive belt. The resulting toner image of the first color is transferred to an intermediate image transfer belt. Subsequently, a second developing unit develops a latent image for a second color formed on the photoconductive belt, and then the resulting toner image is transferred to the intermediate image transfer belt over the toner image present on the belt. Such a process is repeated in a third and a fourth color. The resulting full-color image is transferred from the intermediate image transfer belt to a sheet.

(2) Japanese Patent Laid-Open Publication No. 10-104898, for example, teaches a direct image transfer type of full-color image forming apparatus including four image forming units each including a respective image carrier. Toner images of different colors are directly transferred from the image carriers to a sheet being conveyed by a belt one above the other. This type of image forming apparatus is generally referred to as a tandem image forming apparatus.

(3) Japanese Patent Laid-Open Publication No. 2001-134042, for example, teaches a tandem, indirect image transfer type of image forming apparatus similar to the above type (2) except that it additionally includes an intermediate image transfer belt. After toner images of different colors formed by the image forming units have been sequentially transferred to the intermediate image transfer belt one above the other, the resulting full-color image is transferred from the belt to a sheet.

The prerequisite with tandem color image forming apparatuses of the types (2) and (3) is that the toner images of different colors be transferred to the sheet or the intermediate image transfer belt in accurate register, i.e., without any color shift.

We proposed in Japanese Patent Application No. 13-0005652 an image forming apparatus including correcting means, or color registering means, for correcting the positional shift of the individual image to be transferred to a sheet. More specifically, a plurality of mark sets each comprising a series of marks of different colors are formed within the circumferential length of the outer surface of a belt. Mark sensing means senses the marks of each mark set formed on the belt. Subsequently, a mean value of the shifts of the marks of the same color included in the mark sets is calculated. Thereafter, the correcting means adjusts, based on the calculated mean values, color-by-color image forming timings assigned to image forming units, thereby correcting the shifts of images to be transferred to a sheet one above the other.

Generally, the belt included in an image forming apparatus of the type described above is passed over a plurality of members including a drive member and tension applying means. The drive member causes the belt to move in a preselected direction while the tension applying means applies tension to the belt. When the drive member is implemented as a drive roller, the belt is caused to move by friction acting between the inner surface of the belt and the surface of the drive roller being rotated. A problem with this type of image forming apparatus is that the belt and drive roller are apt to slip on each other during the conveyance of a sheet. This is because load acting on the drive roller is heavier when the belt conveys a sheet than when it does not convey a sheet. As a result, the linear velocity of the belt is apt to vary between the time when the mark sensing means is sensing the mark sets formed on the belt for the correction of shifts and the time when the belt is conveying a sheet. This eventually brings about the shift of an image on a sheet in spite of the operation of the correcting means.

The slip between the belt and the drive roller or drive member stated above is critical not only in a tandem image forming apparatus but also in any other image forming apparatus so long as it conveys a sheet with a belt.

The tandem full-color image forming apparatus of the type (1) or (2) uses a plurality of image carriers and is therefore feasible for high-speed machines. On the other hand, the full-color image forming apparatus of the type (1) uses a single image carrier and is feasible for machines that attach importance to high image quality. However, in parallel with the spread of personal computers, there is an increasing demand for full-color prints and therefore both of high image quality and high printing speed. In this respect, the full-color image forming apparatus using a single image carrier cannot fully meet the demand for high printing speed due to physical limitations. Therefore, the full-color image forming apparatus using a plurality of image carriers should preferably be configured to implement both of high printing speed and high image quality. While high printing speed is physically easy to achieve with the apparatus including a plurality of image carriers, high image quality is the problem.

Among various factors effecting image quality, the positional shift of a toner image stated earlier is considered to be most difficult to cope with in the full-color image forming apparatus using a plurality of image carriers. This is because any change in the speed of a sheet being conveyed via the consecutive image carriers directly translates into a positional shift, i.e., a color shift.

Further, considering the demand for long-life devices and supplies included in an image forming apparatus, various products each are designed in such a manner as to make the most of the individual characteristic.

In light of the above, Japanese Patent Laid-Open Publication No. 5-134529, for example, proposes to reduce the duration of drive of a developing unit as far as possible by determining whether or not an image is present, thereby extending the life of a developer and that of the developing device. However, the movement of a photoconductive element or image carrier, in many cases, becomes irregular due to the coupling and uncoupling of a clutch assigned to development, as discussed in the above document also. This is apt to bring about color shifts in the case of the full-color image forming apparatus using a plurality of image carriers.

The color shift ascribable to the positional shift is discussed in Laid-Open Publication No. 9-50166 mentioned earlier also. More specifically, adhesion acts between a photoconductive belt and an intermediate image transfer belt due to friction and static electricity. Therefore, if the photoconductive belt and intermediate image transfer belt are different in linear velocity from each other, then one of them pulls the other, resulting in a color shift. Further, adhesion ascribable to static electricity is intensified on the cleaned surfaces of the two belts, but is sharply reduced when toner is present between the belts. In fact, when a developing unit contacts the charged photoconductive belt, toner deposited on background reduces adhesion acting between the two belts.

SUMMARY OF THE INVENTION

It is therefore an object of the present invention to provide an image forming apparatus operable at high speed and capable of obviating the shifts of toner images of different colors from each other on a member to which the toner images are to be transferred.

In accordance with the present invention, an image forming apparatus includes image carriers arranged side by side in a preselected direction, developing means each for forming a toner image on one of the image carriers, a drive mechanism for driving in the preselected direction a member to which toner images are to be sequentially transferred from the image carriers one above the other, and image transferring devices each for transferring a toner image from one of the image carriers to the above member. At least during an image forming process, a slip condition is substantially the same throughout all image transfer positions where the image carriers face the member.

BRIEF DESCRIPTION OF THE DRAWINGS

The above and other objects, features and advantages of the present invention will become more apparent from the following detailed description taken with the accompanying drawings in which.

DETAILED DESCRIPTION OF THE PREFERRED EMBODIMENTS

Figure 1:
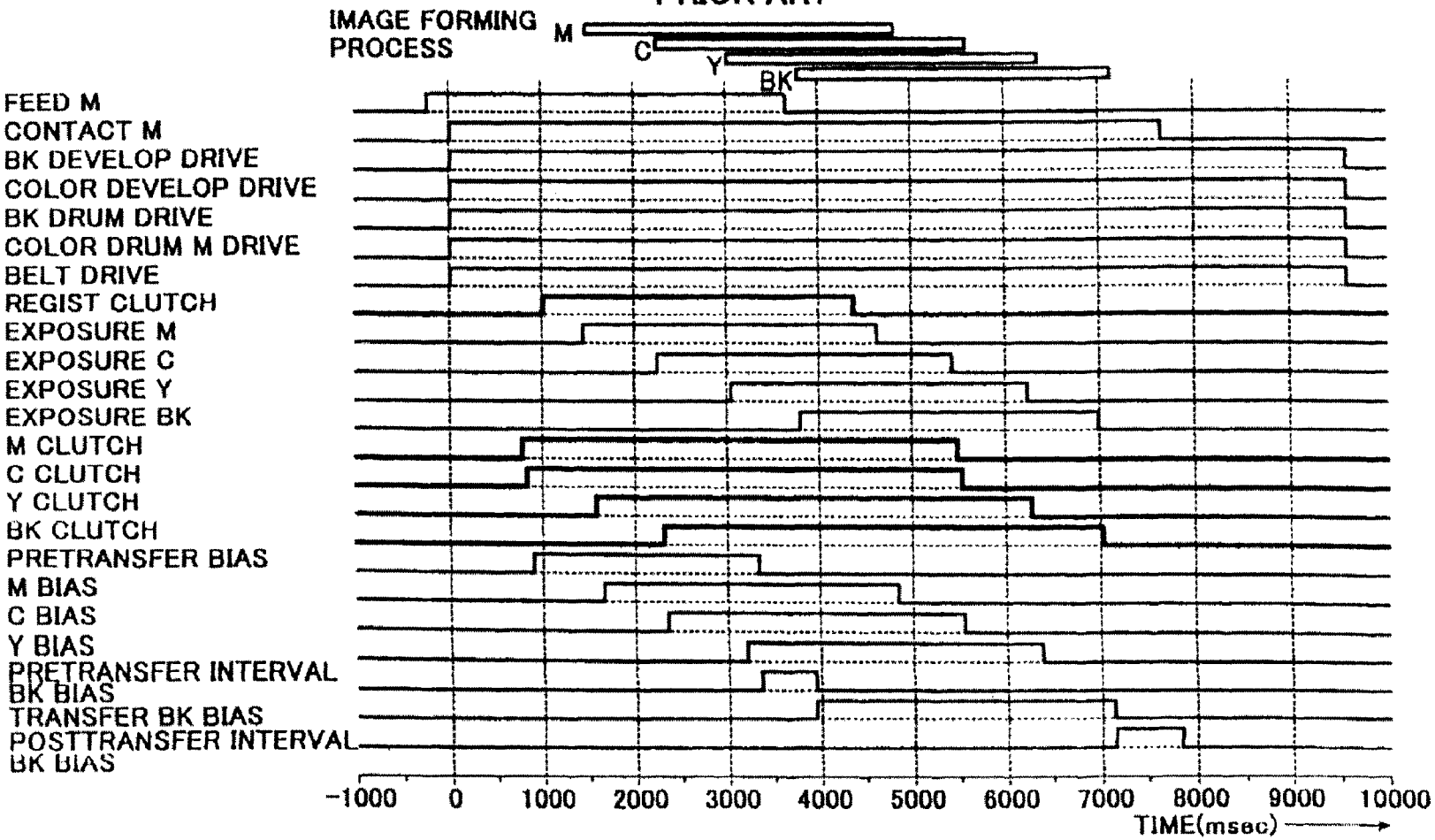
FIG. 1 PRIOR ART
FIG. 1 is a timing chart showing timings for driving image forming factors included in a conventional color image forming apparatus under process control.
Figure 2:
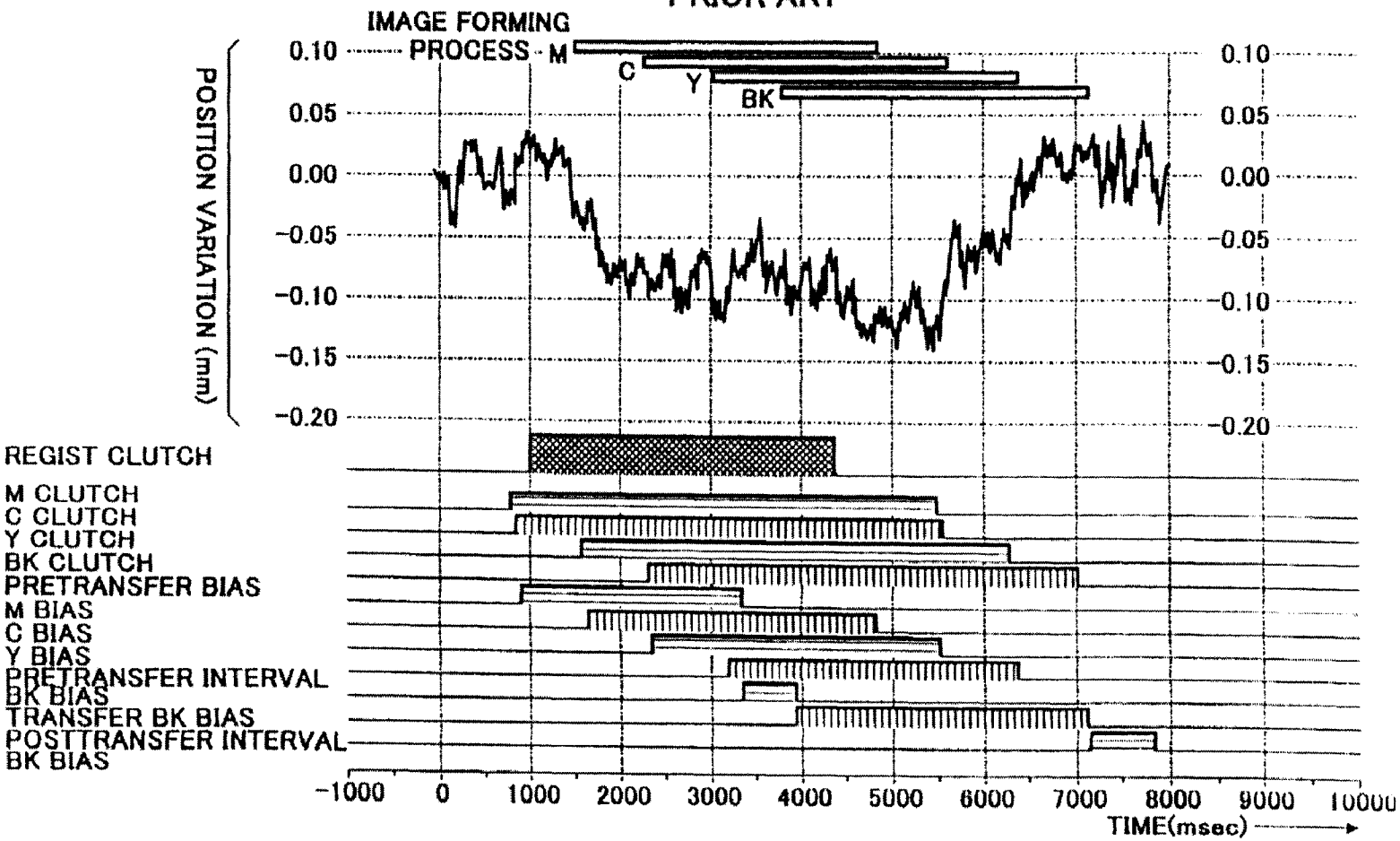
FIG. 2 PRIOR ART
FIG. 2 is a graph showing how the surface position of a conventional belt varied in the direction of movement before, during and after image forming processes.

To better understand the present invention, reference will be made to a conventional tandem color image forming apparatus including four photoconductive drums or image carriers, four developing units and a single image transfer belt and driving each developing unit with an electric motor by coupling a respective clutch at a particular timing. FIG. 1 shows specific drive timings available with this type of image forming apparatus in a full-color mode. FIG. 2 is a graph showing the variation of the surface position of the image transfer belt, which was measured in the direction of movement when a single sheet of size A3 was conveyed at the timings shown in FIG. 1.

As shown in FIG. 2, the surface position of the image transfer belt sharply varies in about 1,200 ms in synchronism with the coupling of the clutch assigned to Y development. Also, the surface position sharply varies in about 5,300 ms in synchronism with the uncoupling of the clutches assigned to M and C development. Further, the surface position varies in about 1,200 ms during the formation (exposure) of an M image and varies in about 5,300 ms during the formation (exposure) of a Y and a K image. Such positional variations ascribable to the conventional coupling and uncoupling timings of the clutches result in color shifts.

More specifically, assume that any one of the photoconductive drums and image transfer belt are driven with the associated clutch being uncoupled, i.e., a sheet is not brought to a nip between the drum and the belt. In this condition, hardly any toner is present on the drum. Therefore, when the drum is pressed against the belt, the surface of the drum, moving at a linear velocity about 1% higher than that of the belt, slightly pulls the belt and causes it to move at a speed higher than the original speed. Specific tandem color image forming apparatuses A through E available on the market are provided with the following ratios of the drum speed to belt speed:

| Apparatus | Ratio (Drum Speed/Belt Speed .times. 100%) |
|---|---|
| A | 101.49 |
| B | 100.29 |
| C | 100.69 |
| D | 100.76 |
| E | 100.11 |

It will be seen that the conventional apparatuses A through E all are configured to move the drum at a higher speed than the belt.

Subsequently, when the clutch is coupled, toner deposits on the drum at the level of background contamination even if an image is absent. On reaching the nip between the drum and the belt, such toner makes slip more noticeable than when it is absent at the nip. It follows that the position of the belt does not vary just after the coupling of the clutch, but varies when, after the coupling of the clutch, the toner deposits on the drum and then reaches the nip between the drum and the belt. In FIGS. 1 and 2, the interval between the time when the clutch is coupled and the time when the position of the belt varies is about 230 ms. This interval corresponds to the sum of a period of time necessary for the drum to move from a nip for development to the nip between it and the belt and the coupling time of the clutch.

Biases for image transfer are synchronous to the movement of a sheet and based on the timing of a registration clutch. More specifically, each bias for image transfer is turned on substantially at the same time as a sheet enters the nip between the associated drum and the belt or image transfer member. Such biases are turned on one after another. Also, each bias is turned off when the sheet moves away from the above nip; the biases are turned off one after another. In this sense, the biases are turned on and turned off during image forming processes.

Figure 3:
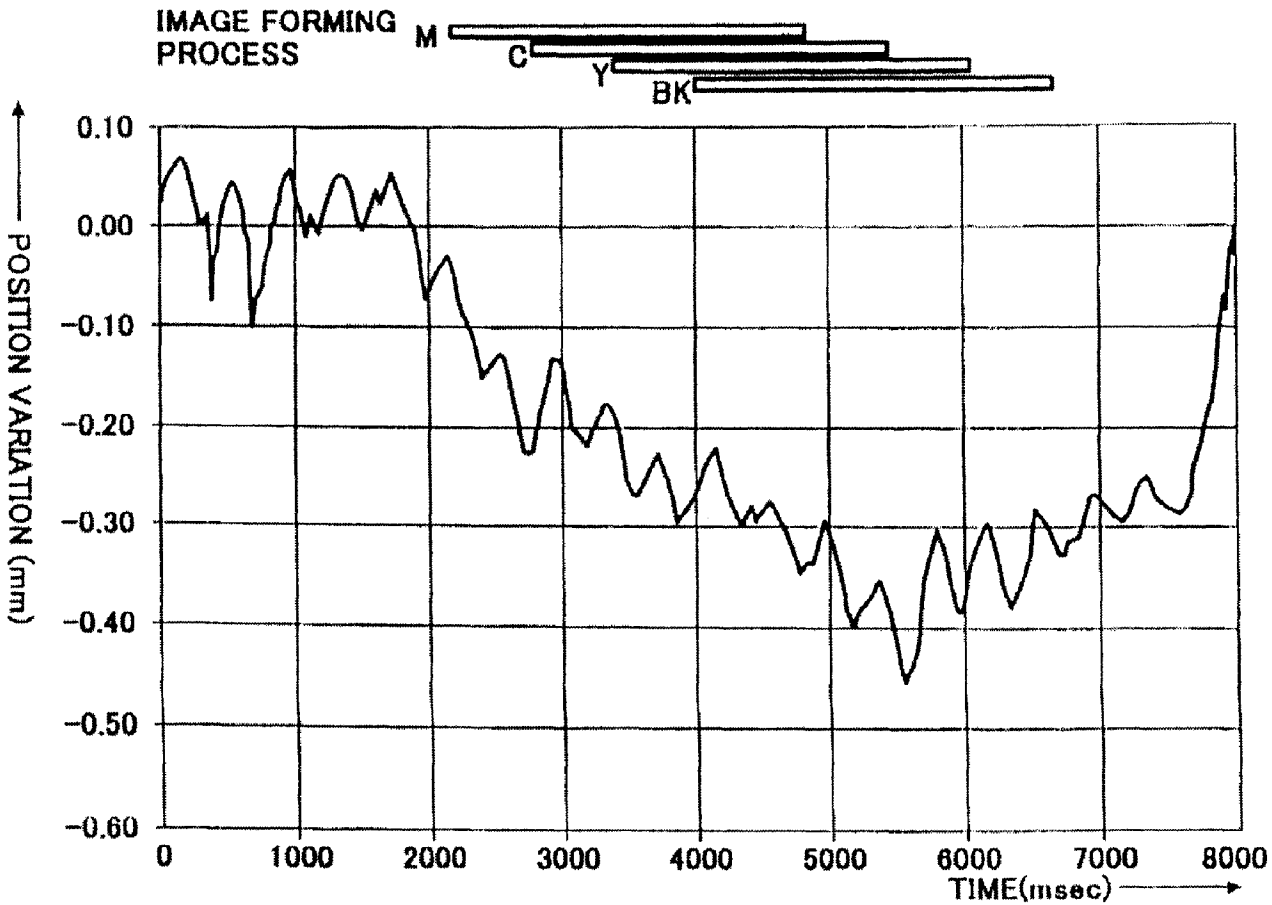
FIG. 3 PRIOR ART
FIG. 3 is a graph showing how the surface position of the conventional belt varied before, during and after image forming processes when image transferring units were repeatedly operated.
Figure 4:
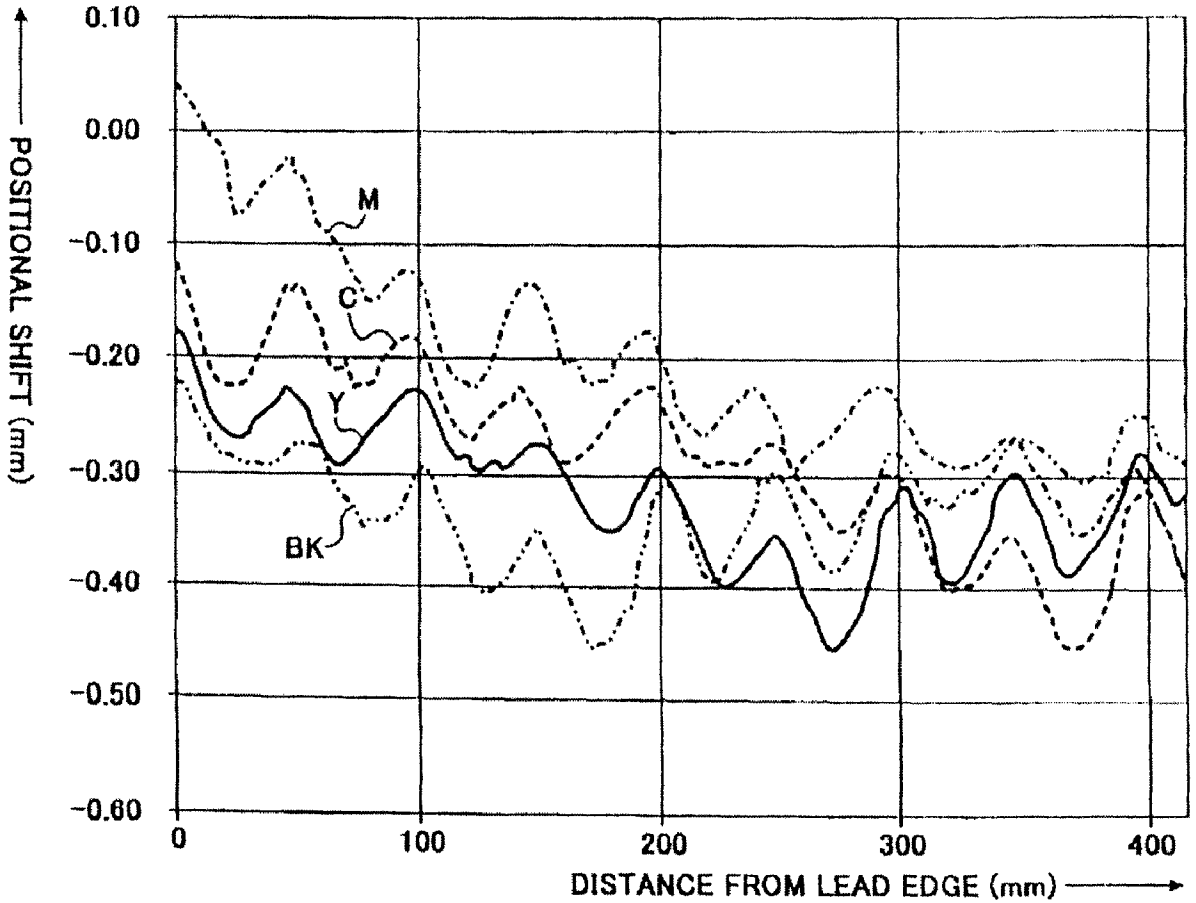
FIG. 4 PRIOR ART
FIG. 4 is a graph showing color shifts derived from the positional shifts of FIG. 3 color by color.
Figure 5:
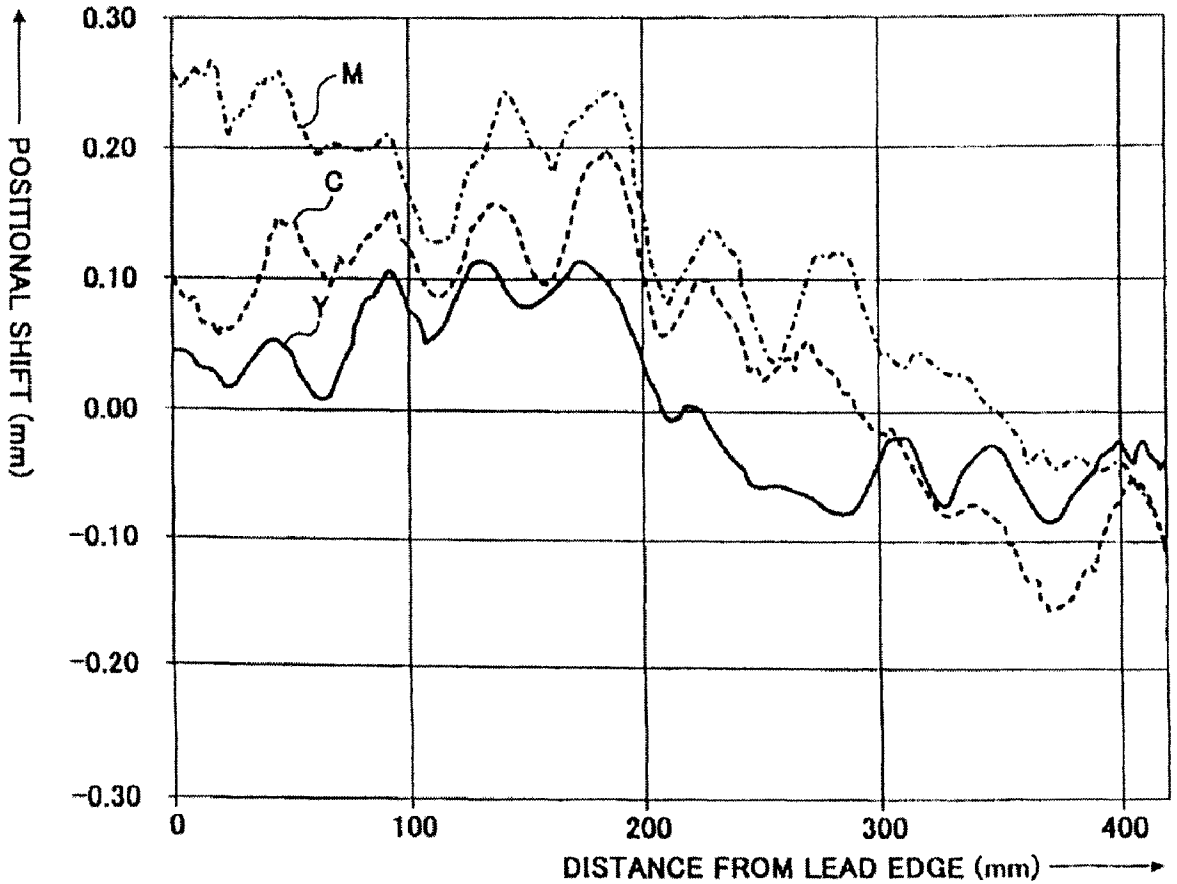
FIG. 5 PRIOR ART
FIG. 5 is a graph showing the positional shifts of M, C, Y and BK derived from the positional shifts of FIG. 4 by calculation.

FIGS. 3 through 5 are graphs showing the variation of the belt surface position measured when a single sheet of size A3 was passed. FIG. 3 corresponds to the variation of the belt surface position shown in FIG. 2. FIG. 4 shows the shifts of an M, a C, a Y and a BK image, which are transferred to the belt, ascribable to the variation shown in FIG. 3; the shifts each were measured during particular one of an M, a C, a Y and a BK image forming process indicated by outline bars above the graph of FIG. 3. FIG. 5 shows the shifts (calculated values) of the M, C and Y images from the BK image of FIG. 4.

The variation of the belt surface position shown in FIG. 3 was also measured by use of the bias applying timings and clutch coupling and uncoupling timings shown in FIG. 1. However, the waveform of FIG. 3 representative of the resulting variation is noticeably different from the conventional waveform of FIG. 2. This difference is ascribable to the aging of image transferring unit, i.e., the variation of characteristics and deterioration ascribable to repeated use. The graph of FIG. 3 was derived from image forming units subjected to a durability test.

By comparing FIGS. 2 and 3, it will be seen that although the bias applying timings influence little at the initial stage (FIG. 2), they come to noticeably influence the stability of movement of the belt as the time elapses (FIG. 3). One of the causes of this occurrence is that the amount of bias for image transfer slightly varies due to the variation of the bias applying member and that of the belt ascribable to aging. This presumably intensifies adhesion between the belt and the bias applying member and causes it to act as load on the drive of the belt, so that the ON/OFF of the bias makes the movement of the belt unstable. Another problem is an increase in speed occurring in about 6,000 ms to 8,000 ms in FIG. 3 due to the linear velocity ratio of the drum to the belt stated earlier. In this manner, the belt speed varies due to the application of the bias for image transfer and the linear velocity ratio. Consequently, the belt speed differs from one image station assigned to one color to another image station assigned to another color, preventing the different colors from being brought into accurate register. For accurate register, the curve shown in FIG. 3 must be straight.

Figure 6:
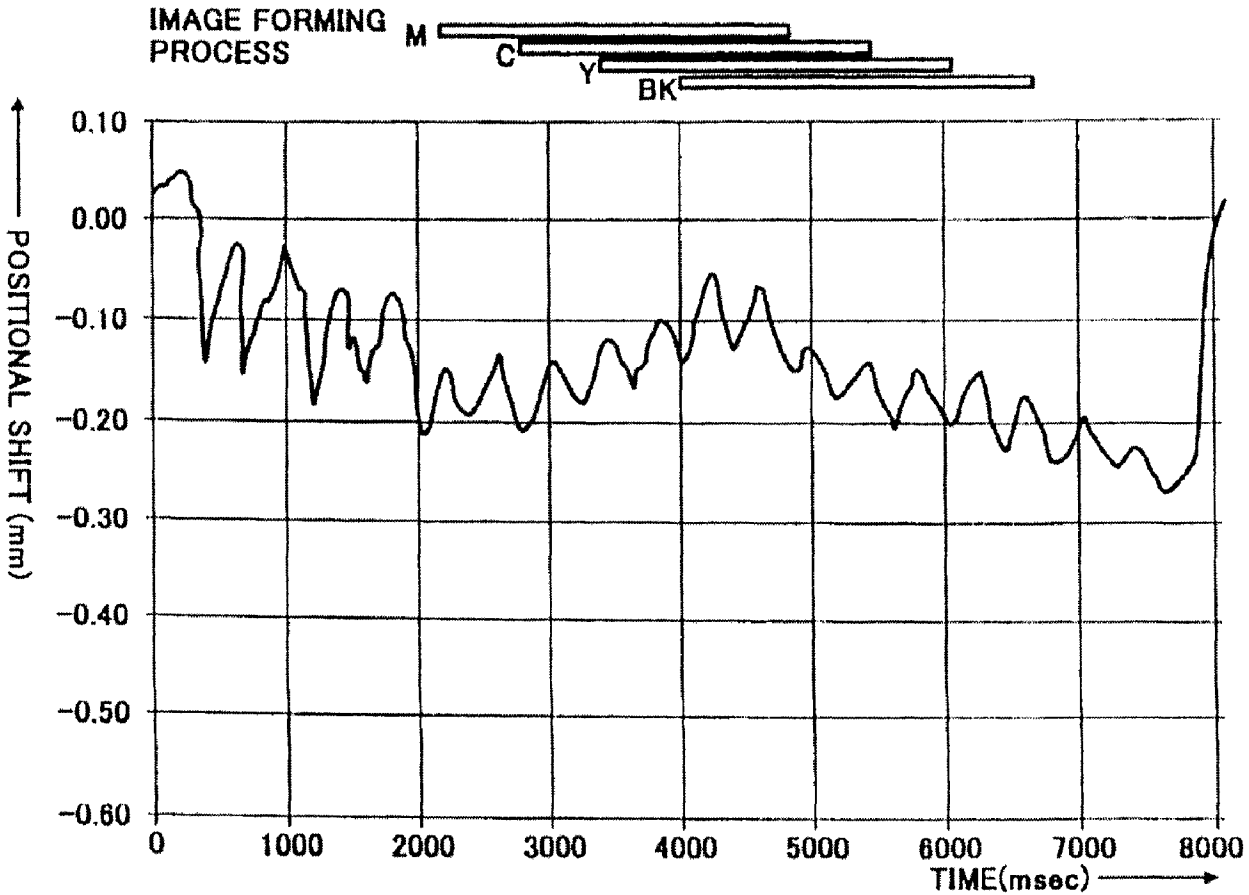
FIG. 6 PRIOR ART
FIG. 6 is a graph showing how the surface position of the belt varied before, during and after image forming processes when the image transferring units were repeatedly used with all image transfer biases being turned off.
Figure 7:
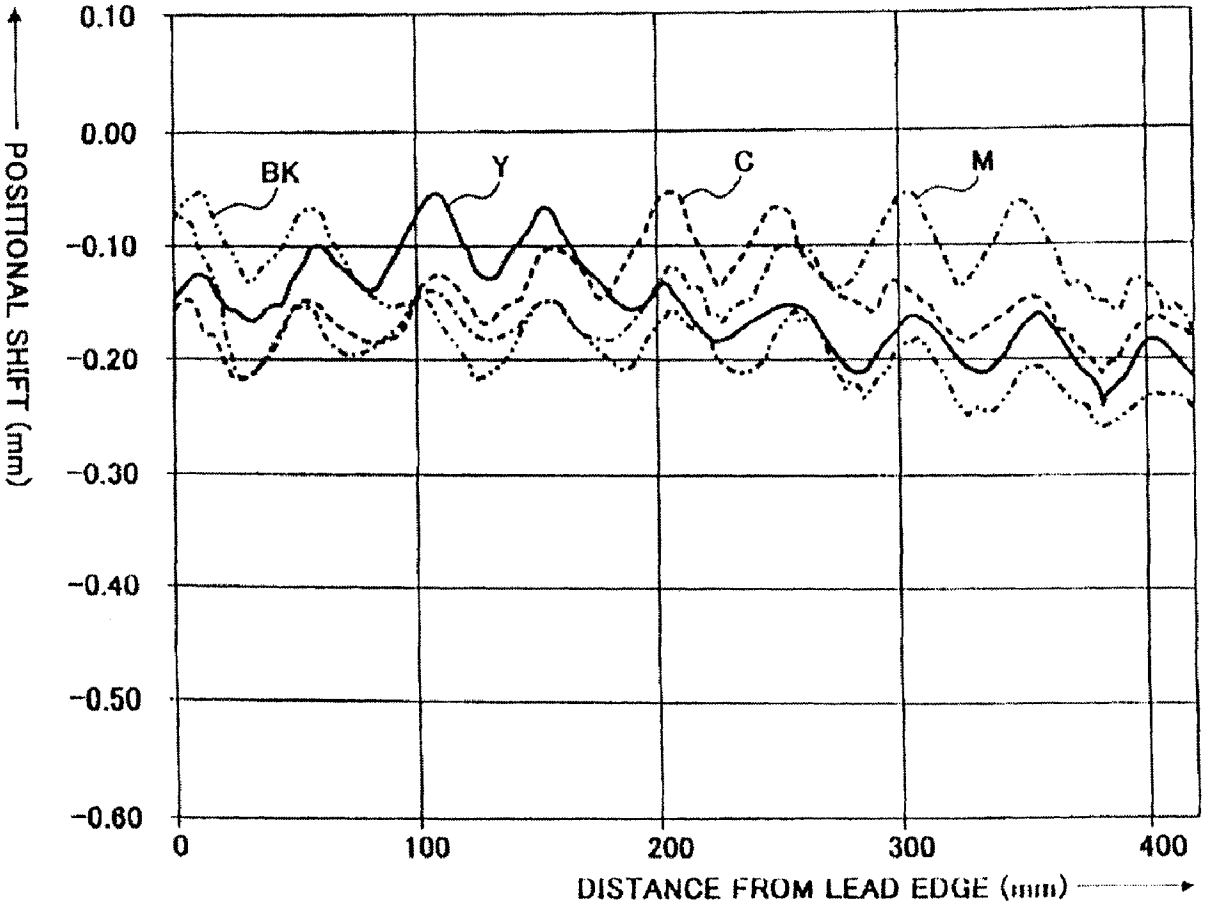
FIG. 7 PRIOR ART
FIG. 7 is a graph showing positional shifts derived from FIG. 6 color by color.
Figure 8:
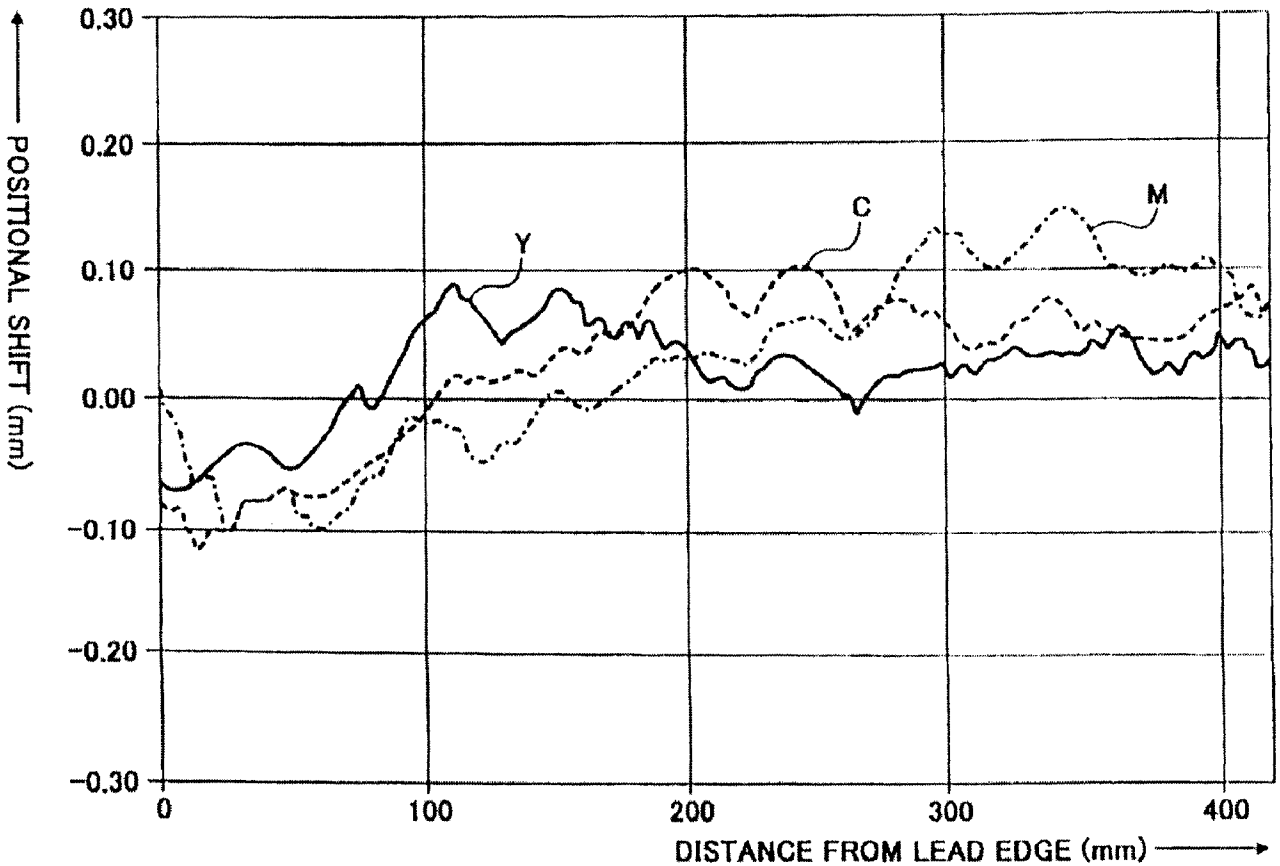
FIG. 8 PRIOR ART
FIG. 8 is a graph showing the positional shifts of M, C and Y from BK derived from the positional shifts of FIG. 7.

FIGS. 6 through 8 show waveforms obtained when a sheet was passed without the biases for image transfer being applied to the image transferring units during the durability test. FIG. 6 corresponds to the variation of the belt position stated with reference to FIGS. 2 and 3. FIG. 7 shows the shifts of image transfer positions ascribable to the variation of the belt position color by color; the shifts each were measured during particular one of an M, a C, a Y and a BK image forming process indicated by outline bars above the graph of FIG. 6. FIG. 5 shows the shifts (calculated values) of the M, C and Y images from the BK image. As shown, the decrease in speed or the shifts shown in FIGS. 3 through 5 occurs little. It will therefore be seen that as the image transferring units are repeatedly used, the influence of the ON/OFF of the image transferring units appears in the variation of the belt surface position of FIG. 3.

Preferred embodiments of the image forming apparatus in accordance with the present invention will be described hereinafter.

First Embodiment

Figure 9:
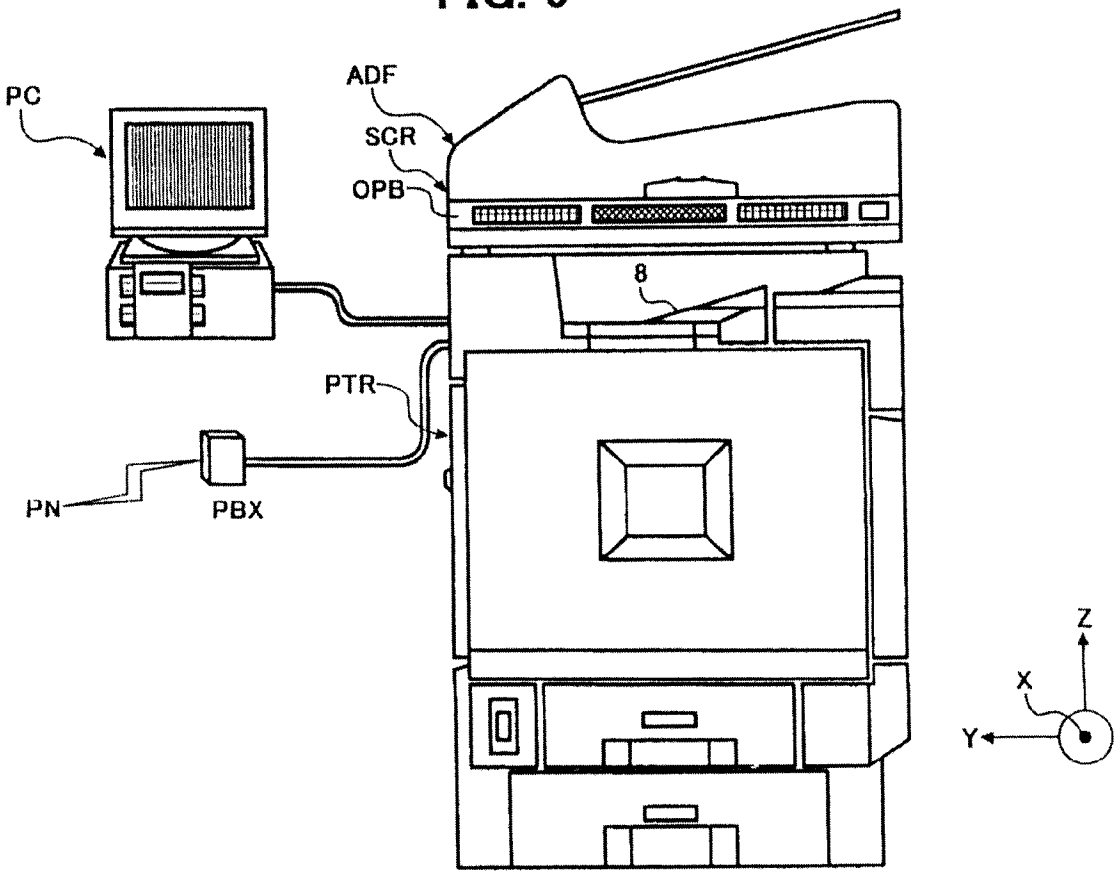
FIG. 9 is a front view showing a first embodiment of the image forming apparatus in accordance with the present invention.

Referring to FIG. 9, an image forming apparatus embodying the present invention is shown and implemented as a multifunction copier by way of example. As shown, the copier is generally made up of an ADF (Automatic Document Feeder), an operation board OPB, a scanner SCR, and a color printer PRT. A personal computer PC and a private branch exchange (simply exchange hereinafter) PBX are connected to a multifunction controller disposed in the copier. The exchange PBX is connected to a telephone line or facsimile communication line PN. Sheets or prints sequentially driven out of the printer PRT are stacked on a print tray 8.

Figure 10:
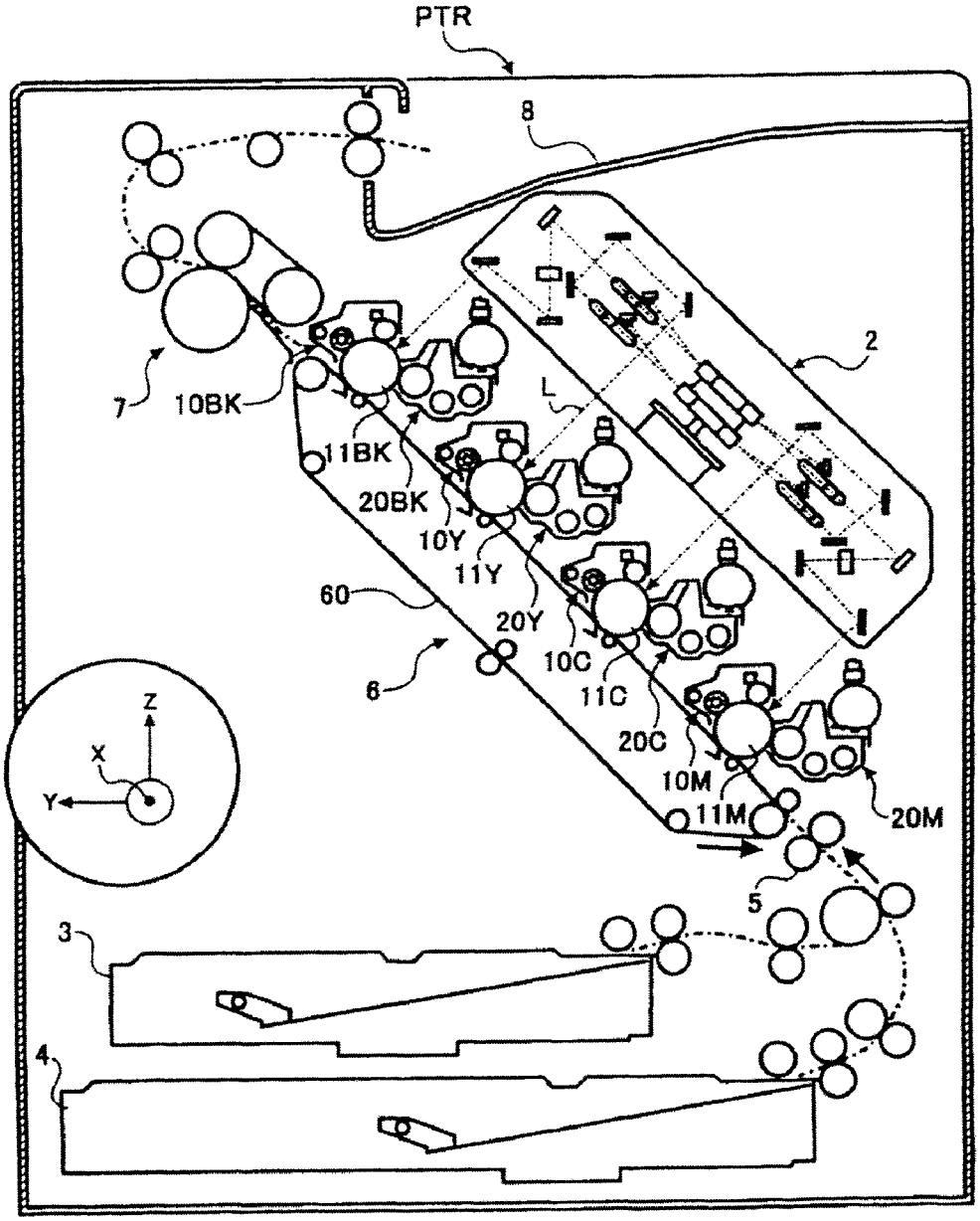
FIG. 10 is a view showing an image forming mechanism included in the first embodiment.

FIG. 10 shows the color printer PTR implemented as a tandem full-color laser printer in detail. As shown, the laser printer PTR includes four, toner image forming stations for respectively forming an M, a C, a Y and a BK toner image. The M to BK toner image forming stations are arranged in this order in the direction of sheet conveyance, which is inclined upward from the bottom right toward the top left of FIG. 10.

The M, C, Y and BK toner image forming stations respectively include drum units 10M, 10C, 10Y and 10BK, which respectively include photoconductive drums 11M, 11C, 11Y and 11BK, and developing units 20M, 20C, 20Y and 20BK. It is to be noted that the photoconductive drums 11M through 11 BK each are a specific form of an image carrier. The M to BK toner image forming stations are arranged such that the axes of the drums 11M through 11BK are parallel to a horizontal axis x and positioned at a preselected pitch in the direction of sheet conveyance, which is incline rightward upward by 45.degree. relative to an axis yin a y-z plane. In the illustrative embodiment, the drums 11M through 11BK each have a diameter of 30 mm and have an OPC (Organic PhotoConductor) layer on its circumference.

The laser printer PTR additionally includes an optical writing unit 2, sheet cassettes 3 and 4, a belt unit 6, and a fixing unit 7 of the type using a belt. The belt unit 6 includes a belt or conveying member 60 for conveying a sheet via the consecutive toner image forming stations. A manual feed tray, toner containers, a waste toner bottle, a duplex copy unit and a power supply unit are also mounted on the laser printer PTR, although not shown specifically.

The optical writing unit 2 includes light sources, a polygonal mirror, f-.theta. lenses and mirrors and scans the surface of each of the drums 11M through 11Y with a particular laser beam in accordance with image data; the laser beam is steered in the direction x. A dash-and-dot line shown in FIG. 10 indicates a path along which a sheet is conveyed. More specifically, a sheet paid out from either one of the sheet cassettes 3 and 4 is conveyed by feed roller pairs to a registration roller pair 5 while being guided by guides not shown. The registration roller pair 5 once stops the sheet and then drives it at a preselected timing toward the belt 60. The belt 60 conveys the sheet via the consecutive toner image forming stations, as mentioned earlier.

Toner images formed on the drums 11M though 11BK are sequentially transferred to the sheet being conveyed by the drum 60 one above the other, completing a full-color toner image on the sheet. While the sheet with the full-color toner image is passed through the fixing unit 7, the fixing unit 7 fixes the toner image on the sheet. Finally, the sheet or print is driven out to the print tray 8.

As stated above, in the illustrative embodiment, the toner images of different colors are directly transferred to a sheet one above the other (direct image transfer system). In the illustrative embodiment, the drums 11M through 11BK each are driven at a linear velocity of about 125 mm/sec, which is higher than the linear velocity of the belt 60 by about 1%. It follows that the ratio of the drum speed to the belt speed is about 101%.

Figure 11:
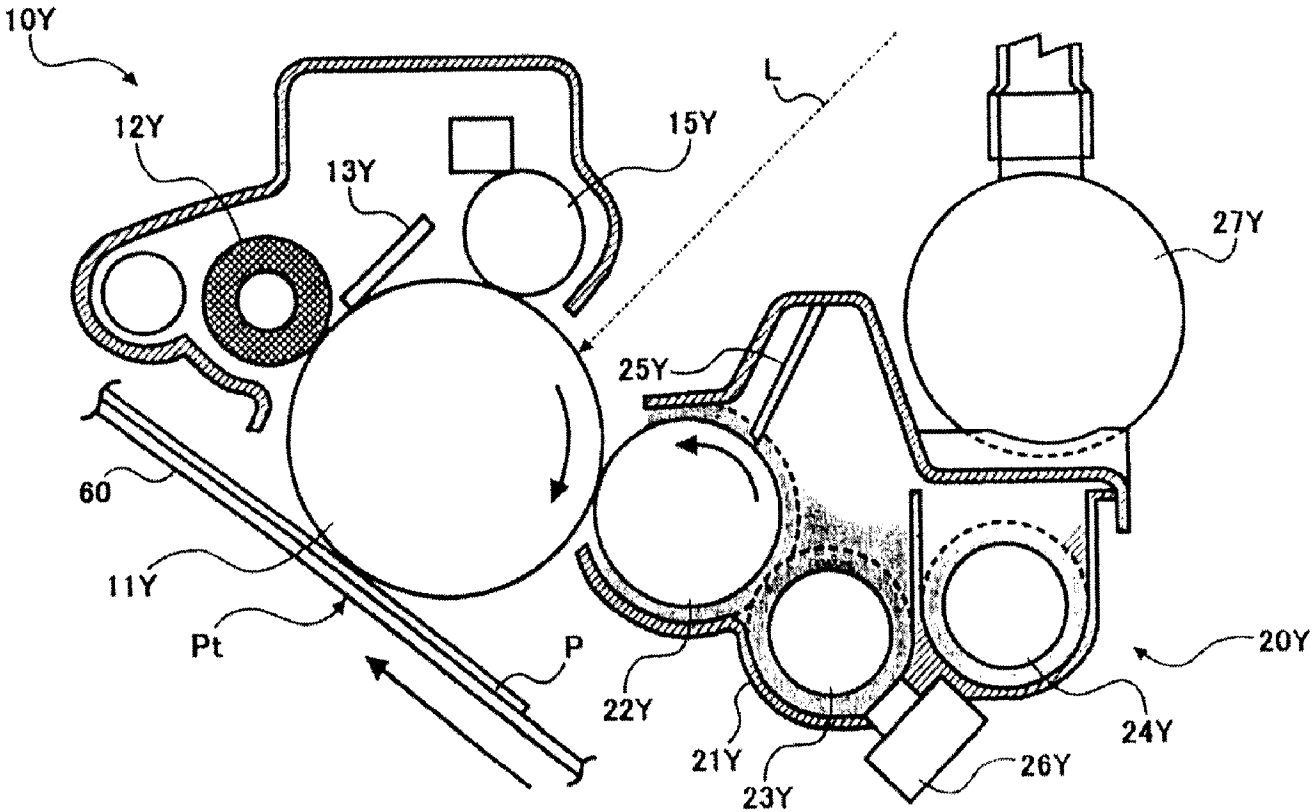
FIG. 11 is an enlarged section showing a drum unit and a developing unit included in the first embodiment and assigned to Y each by way of example.

FIG. 11 shows only the Y toner image forming station in detail by way of example. The M, C and BK toner image forming stations also have the configuration to be described hereinafter. As shown, in the Y toner image forming station, the drum unit 10Y includes, in addition to the drum 11Y, a brush roller 12Y for coating a lubricant on the drum 11Y, an angularly movable blade 13Y for cleaning the drum 11Y, a quenching lamp, not shown, for discharging the drum 11Y, and a non-contact type charge roller 15Y for uniformly charging the drum 11Y.

In operation, the charge roller 15Y, applied with an AC voltage, uniformly charges the surface of the drum 11Y. The optical writing unit 2 scans the charged surface of the drum 11Y with a laser beam L modulated in accordance with image data and steered by the polygonal mirror, thereby forming a latent image on the drum 11Y. Subsequently, the developing unit 20Y develops the latent image with Y toner to thereby produce a Y toner image. At a position Pt, the Y toner image is transferred from the drum 11Y to a sheet P being conveyed by the belt 60. After the image transfer, the brush roller 12Y coats a preselected amount of lubricant on the surface of the drum 11Y, and then the blade 13Y cleans the surface of the drum 11Y. Further, the quenching lamp discharges the surface of the drum 11Y for thereby preparing it for the next image forming cycle.

The developing unit 20Y stores a two-ingredient type developer, i.e., a mixture of magnetic carrier grains and negatively charged toner grains. The developing unit 20Y includes a case 21Y, a developing roller 22Y facing the drum 11Y via an opening formed in the case 21Y, screw conveyors 23Y and 24Y, a doctor blade 25Y, a toner content sensor 26Y, and a powder pump 27Y. The developer stored in the case 21Y is charged by friction while being conveyed by the screw conveyors 23Y and 24Y and is partly deposited on the surface of the developing roller 22Y. While the developing roller 22Y in rotation conveys the developer toward the drum 11Y, the doctor blade or metering member 25Y regulates the thickness of the developer forming a layer on the roller 22Y. The developer is then transferred from the developing roller 22Y to the drum 11Y, developing a toner image carried on the drum 11Y. When the toner content of the developer in the case 21 is short, as sensed by the toner content sensor 26Y, the powder pump 27Y is driven to replenish fresh toner to the case 21.

Referring again to FIG. 10, a single electric motor (color drum motor hereinafter), not shown, drives the drums 11M, 11C and 11Y via a drive transmission system and a speed reducer, not shown, by one-step speed reduction. A single electric motor (K drum motor), not shown, dives the drum 11K via a drive transmission system and a speed reducer, not shown, by one-step speed reduction. The output torque of the K drum motor is additionally transferred to a drive roller 62, which drives the belt 60, via a drive transmission system.

An electric motor, not shown, assigned to the fixing unit 7 drives the developing unit 20K as well via a drive transmission system and a clutch not shown. On the other hand, an electric motor, not shown, assigned to the registration roller pair S drives the other developing units 20M, 20C and 20Y as well via a drive transmission system and clutches not shown. The clutches mentioned above each are selectively coupled or uncoupled such that associated one of the developing units 20M through 20BK is driven only at a preselected timing.

Figure 12:
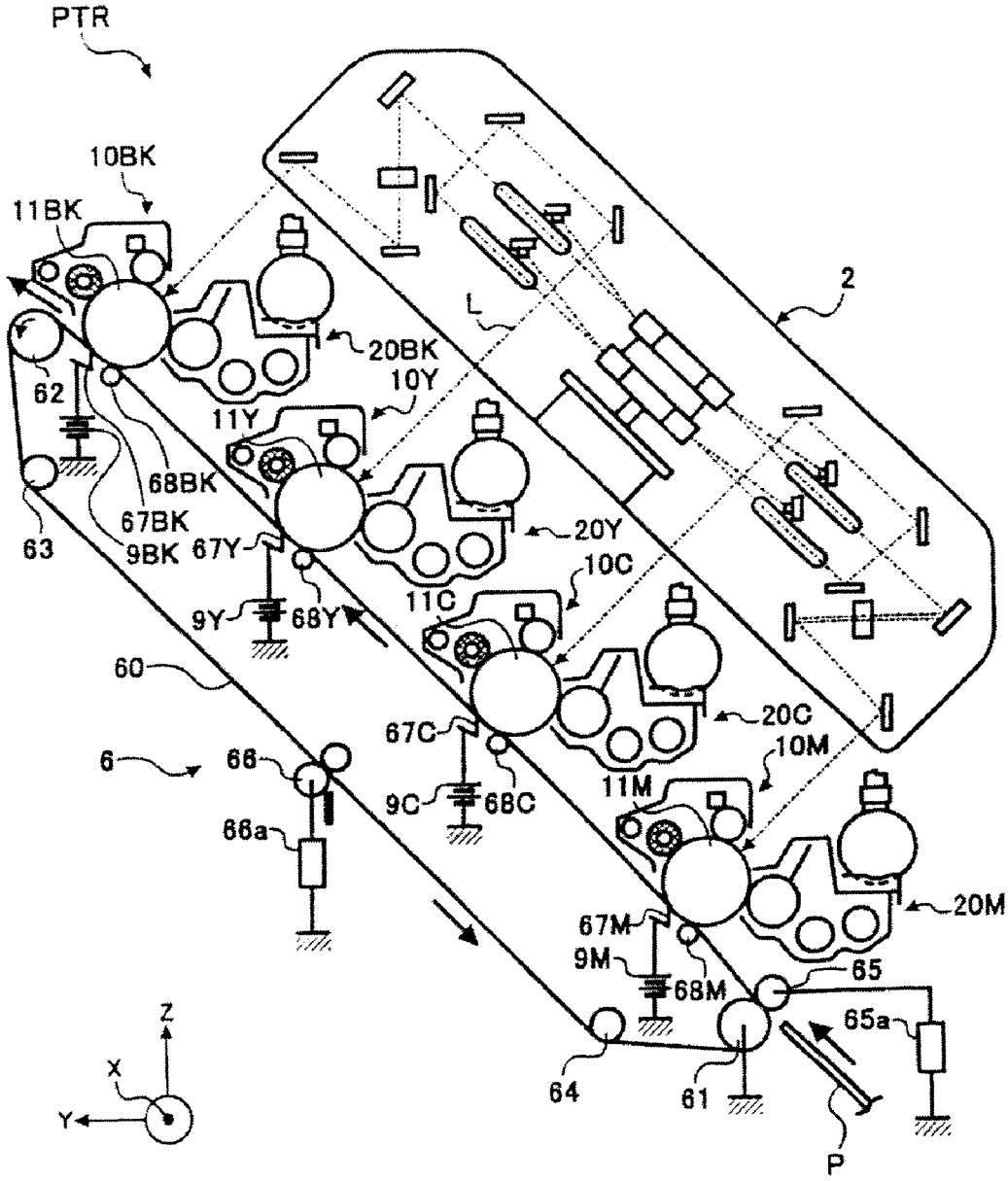
FIG. 12 is an enlarged view showing a belt unit included in the first embodiment in detail.

FIG. 12 shows the belt unit 6 more specifically. In the illustrative embodiment, the belt 60 is implemented as an endless, single-layer belt formed of PVDF (polyvinylidene fluoride) and provided with volume resistivity as high as between 10.sup.9.OMEGA.cm and 10.sup.11.OMEGA.cm. As shown in FIG. 12, the belt 60 is passed over four grounded rollers 61 through 64 such that it moves via image transfer positions in contact with the drums 11M through 11BK. The roller or inlet roller 61, located at the upstream side in the direction of sheet conveyance, faces an adhesion roller 65 to which a preselected voltage is applied from a power supply 65*a*. The inlet roller 61 causes the sheet P being conveyed by the belt 60 to electrostatically adhere to the belt 60. The drive roller or outlet roller 62 located at the downstream side in the above direction drives the belt 60 by friction and is connected to the drive source not shown. A bias roller 66 is held in contact with the outer surface of the belt 60 between the rollers 63 and 64 and applied with a preselected cleaning voltage from a power supply 66*a*. The bias roller 66 removes residual toner and other impurities from the belt 60.

Bias applying members or electric field forming means 67M, 67C, 67Y and 67BK are held in contact with the portions of the inner surface of the belt 60 contacting the drums 11M, 11C, 11Y and 11BK, respectively. The bias applying means 67M through 67BK each are implemented as a stationary brush formed of Mylar and applied with a bias for image transfer from one of power supplies 9M, 9C, 9Y and 9BK. The bias applying means 67M through 67BK each apply a charge for image transfer to the drum 60 at a particular image transfer position, forming an electric field having preselected strength between the belt 60 and the associated drum.

Figure 13:
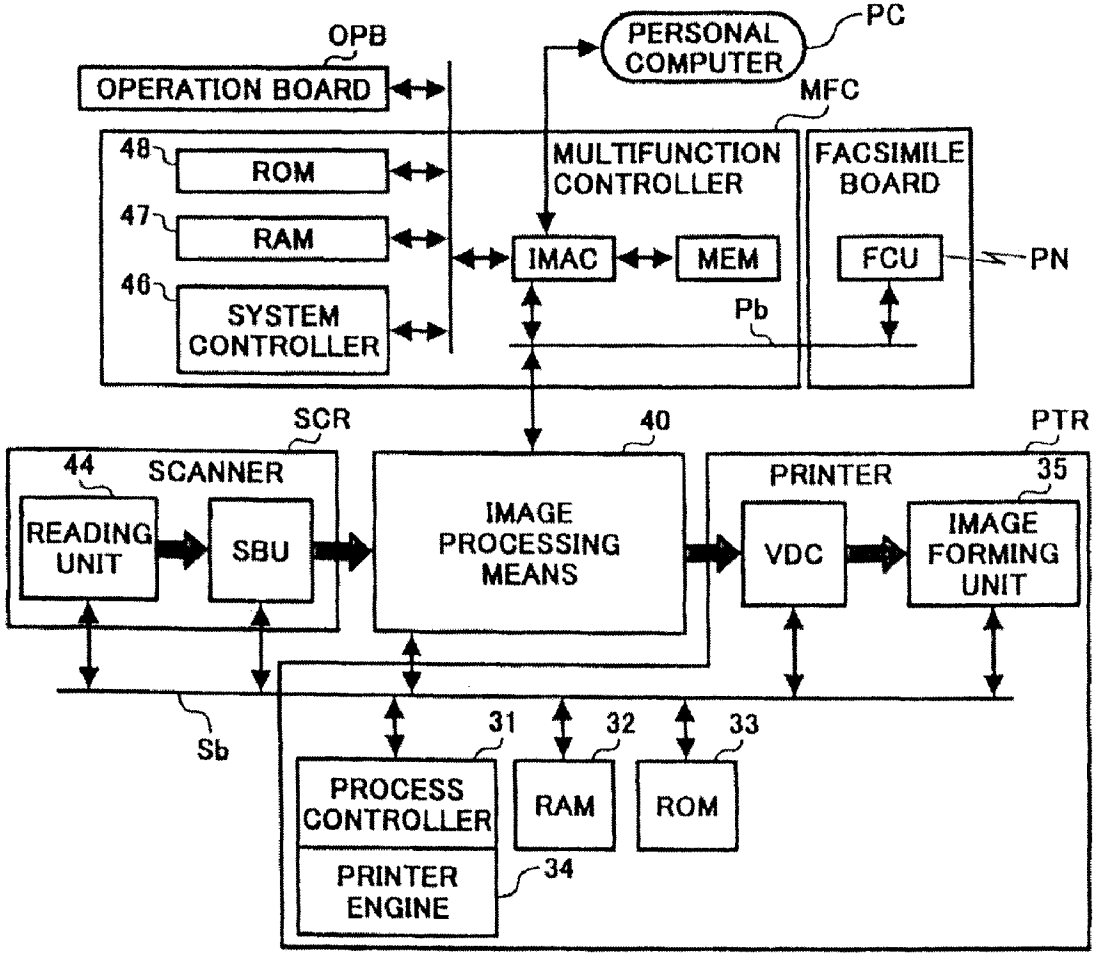
FIG. 13 is a schematic block diagram showing a control system included in the first embodiment.

FIG. 13 shows a control system included in the illustrative embodiment. As shown, a scanner SCR includes a reading unit 44 configured to illuminate a document with a light source and focuses the resulting reflection from the document on a sensor via mirrors and a lens. The sensor is implemented as a CCD (Charge Coupled Device) image sensor in the illustrative embodiment and included in an SBU (Sensor Board Unit). The resulting electric signal output from the CCD image sensor is digitized, i.e., converted to corresponding image data by the SBU and then sent to image processing means 40.

A system controller 46 and a process controller 31 communicate with each other via a parallel bus Pb and a serial bus Sb. The image processing means 40 converts a data format for interfacing the parallel bus Pb and serial bus Sb. On receiving the image data from the SBU, the image processing means 40 corrects signal deterioration ascribable to the optics and quantization particular to digitization. The corrected image data are sent to an MFC (MultiFunction Controller) and written to a memory module MEM or are sent to the printer PTR after adequate processing.

More specifically, the image processing means 40 selectively performs a first job for storing the image data in the memory MEM so as to allow them to be reused or a second job for sending the image data to a VDC (Video Data Controller) so as to allow the laser printer PTR to print an image. With the first job, it is possible to operate, in a repeat copy mode, the reading unit 44 only once and store the resulting image data in the memory MEM, so that the image data can be repeatedly used. As for the second job, when a single copy should be copied only once, the resulting image data should only be directly sent to the printer PTR.

More specifically, as for the second job that does not use the memory MEM, the image processing means 40 corrects the image data, then deals with image quality for converting the image data to area tonality, and then transfers the image data to the VDC. The VDC executes postprocessing with the area tonality signal as to dot arrangement and executes pulse control for the reproduction of dots. In the laser printer PRT, the image forming unit 35 prints an image on a sheet in accordance with the processed image data output from the VDC.

Assume that the first job that uses the memory MEM is effected to, e.g., rotate an image or combine images. Then, the corrected image data are sent from the image processing means 40 to an IMAC (Image Memory Access Controller) via the parallel bus Pb. The IMAC, controlled by the system controller 46, executes access control over the image data and memory MEM, conversion of character codes input from the personal computer PC, FIG. 9, to character bits, and compression/expansion of the image data for the efficient use of the memory. Compressed image data output from the IMAC are written to the memory MEM, so that they can be read out later. The image data read out of the memory MEM are expanded to the original image data by the IMAC and then returned to the image processing means 40 via the parallel bus Pb.

The image processing section 40 executes image quality processing with the image data returned from the IMAC as well as pulse control for VDC. Subsequently, the image forming unit 35 forms a toner image on a sheet.

As for facsimile transmission also available with the illustrative embodiment, the image data output from the scanner SCR are processed by the image processing means 40 and then transferred to an FCU (Facsimile Control Unit) via the parallel bus Pb. The FCU formats the input image data to the telephone line PN, FIG. 9, or public switched telephone network and then sends the formatted image data to the telephone line PN as facsimile data. On the other hand, facsimile data received via the telephone line PN are converted to image data by the FCU and then transferred to the image processing means 40 via the parallel bus Pb and a CDIC (Color Data Interface Controller). In this case, the VDC simply executes dot rearrangement and pulse control without the image quality processing being executed, so that the image forming unit 35 forms a toner image in accordance with the image data output from the VDC.

Assume that a plurality of jobs, e.g., the copy function, facsimile transmission/receipt function and printer function should be used in parallel. Then, the system controller 46 and process controller 31 controls the allocation of the right to use the reading unit 44, image forming unit 35 and parallel bus Pb.

The process controller 31 controls the flow of image data while the system controller 47 controls the entire system and supervises the start-up of the individual resource. More specifically the operator of the copier inputs desired functions on an operation board OPB and sets the contents of the copying function, facsimile function and so forth.

A printer engine 34 shown in FIG. 13 is representative of electric drive circuitry included in the printing mechanism or image forming mechanism shown in FIG. 10. The printing mechanism includes motors, solenoids, charger, heater, lamps and other electric devices, electric sensors, and drivers for driving them. The process controller 31 controls the operation of such electric circuitry while monitoring the outputs or statuses of the electric sensors.

Figure 14:
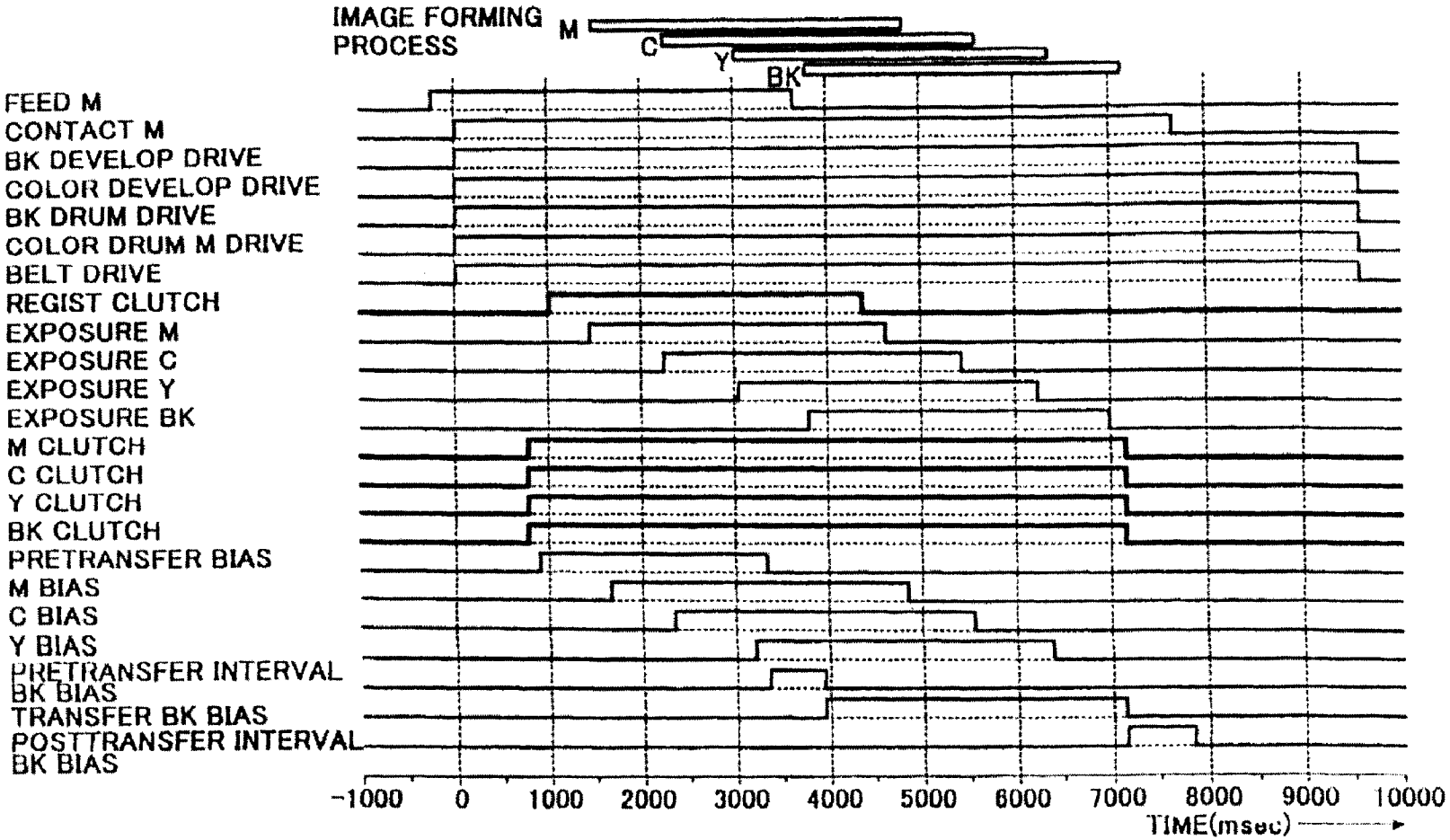
FIG. 14 is a timing chart showing timings for driving image forming factors of FIG. 10 under color print process control.

FIG. 14 demonstrates a specific operation timing based on the image forming process control of the process controller 31. The timing shown in FIG. 14 differs from the conventional timing of FIG. 1 as to the ON/OFF of the M, C, Y and BK clutches. As shown, the sheet P reaches the M image transfer position in synchronism with the turn-on of the M transfer bias on the basis of the time when a registration clutch is coupled (positive going edge in FIG. 14). The registration clutch connects the registration roller pair 5 to the drive transmission system when coupled.

In the conventional timing shown in FIG. 1, an M and a C clutch are coupled at substantially the same time, but clutches assigned to the other colors are coupled or uncoupled one after the other. In this manner, the conventional clutches are coupled and uncoupled when the image forming processes are under way. By contrast, as shown in FIG. 14, the illustrative embodiment couples and uncouples the clutches when the image forming processes are not under way.

Figure 15:
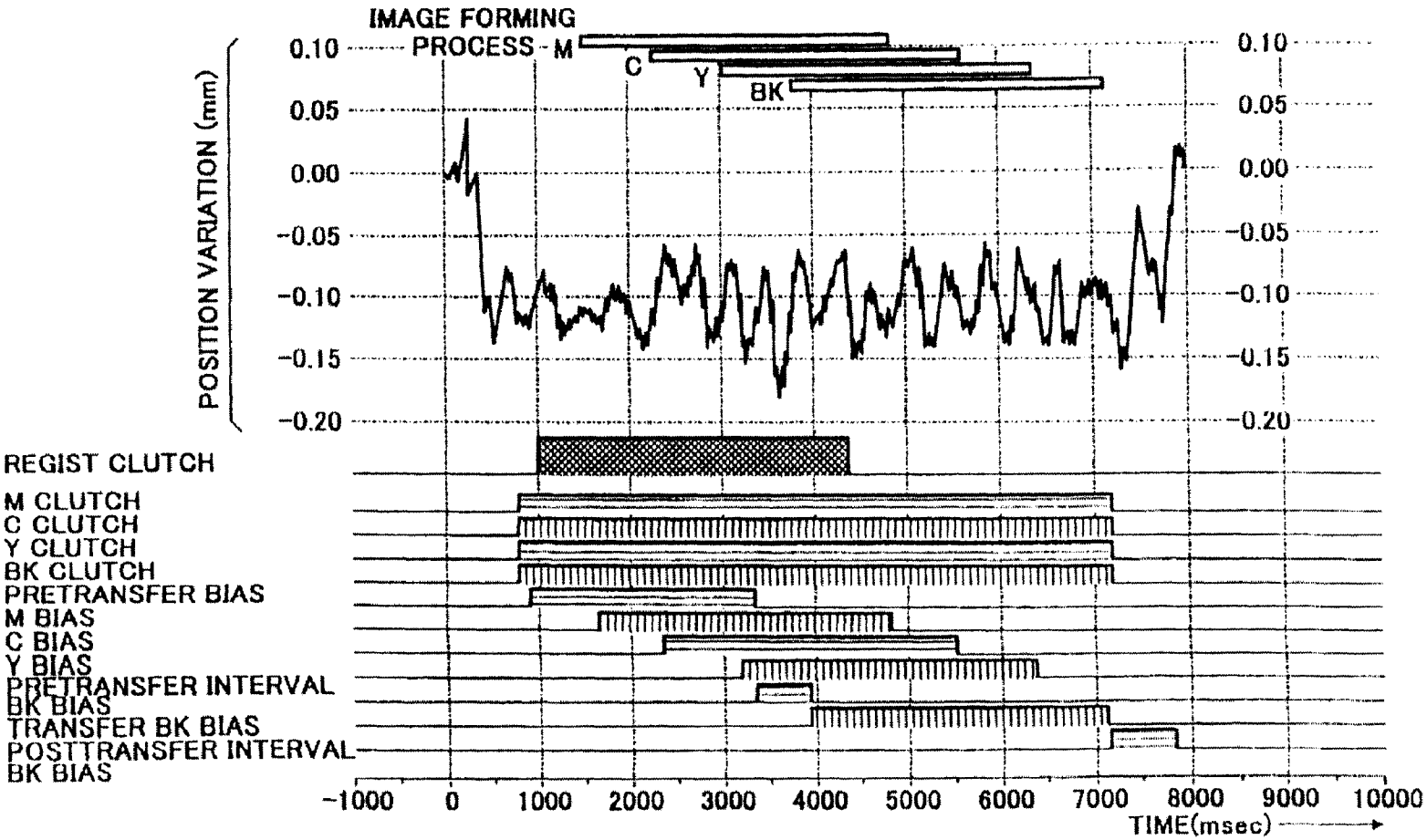
FIG. 15 is a graph showing how the surface position of a belt of FIG. 10 varied in the direction of movement before, during and after image forming processes.

FIG. 15 is a graph showing the variation of the belt surface position measured at the timing of FIG. 14 when a single sheet of size A3 was passed and will be compared with the graph of FIG. 2 hereinafter. More specifically, FIG. 15 shows the shifts of the actual image transfer position in the direction tangential to each drum from the virtual image transfer position that will hold if the sheet surface contact the various points of the drum surface at precisely the same linear velocity.

As for the conventional timing shown in FIG. 2, the belt surface position sharply varies in about 1,200 ms due to the coupling of the Y clutch and varies in about 5,300 ms due to the uncoupling of the M and C clutches. In FIGS. 1, 2 and 14 through 16, outline bars indicate the duration of the M, C, Y and BK image forming processes. Also, in FIGS. 2 and 15, rectangular waves indicate the coupling and uncoupling of the registration clutch as well as those of the other clutches; the high level and low level indicate coupling (drive) and uncoupling (stop of drop), respectively.

In the case of FIG. 2, the position variations in about 1,200 ms and about 5,300 ms occur during M image formation and Y and BK image formation, respectively, resulting in color shifts. By contrast, in the case of FIG. 15, sharp position variation does not occur during image forming process, so that color shifts are is not conspicuous.

When the drums 11M through 11BK and belt 60 are driven with the clutches being uncoupled, i.e., before the sheet P reaches the nip between the drum 11M and the belt 60, hardly any toner is present on the drums 11M through 11BK. In this condition, the belt 60 is moving at a speed higher than the original speed by being slightly pulled by the drums 11M through 11BK, which are higher in linear velocity than the belt 60 by about 1%. Subsequently, when clutches are coupled, toner deposits on the drums at the level of background contamination even if images are absent. On reaching the nip between any one of the drums and the belt, such toner makes slip more noticeable than when it is absent at the nip, i.e., varies the amount by which the belt 60 is pulled by the drum. It follows that the position of the belt does not vary just after the coupling of the clutch, but varies when, after the coupling of the clutch, the toner deposits on the drum and then reaches the nip between the drum and the belt. In the illustrative embodiment, the interval between the time when the clutch is coupled and the time when the above toner arrives at the nip is about 230 nm. In FIGS. 1 and 2, the interval between the time when the clutch is coupled and the time when the position of the belt varies is about 230 ms. In fact, as shown in FIG. 2, the waveform does not sharply vary just after the coupling or uncoupling of the clutch, but varies in about 230 nm.

In the illustrative embodiment, the positional shift remains stable at about 0.10 mm throughout the image forming processes M through BK shown in FIG. 15.

Second Embodiment

A second embodiment of the present invention will be described hereinafter. The second embodiment is essentially similar to the first embodiment as to hardware, image data processing, and image formation control. The second embodiment differs from the first embodiment as to the timing for the process controller 31 to couple and uncouple the image transfer biases.

Figure 16:
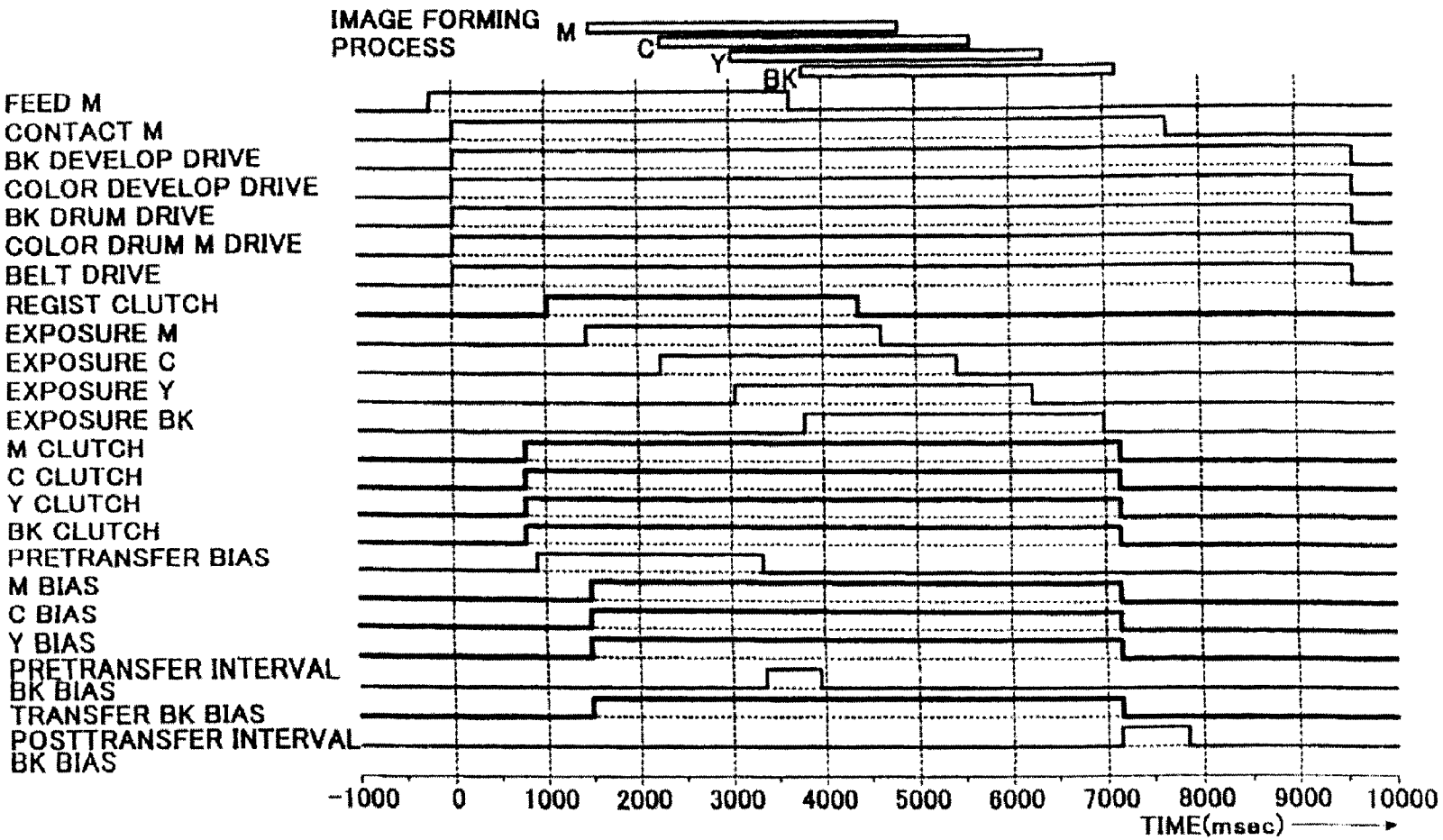
FIG. 16 is a timing chart showing timings for driving the image forming factors under color print process control and representative of a second embodiment of the present invention.

More specifically, FIG. 16 shows the timings of various image forming factors controlled by the process controller 31 in the illustrative embodiment. As shown, the timings of FIG. 16 differs from those of FIG. 1 as to the coupling/uncoupling of the M, C, Y and BK clutches and ON/OFF of the M, C, Y and K biases. It is to be noted that the coupling/uncoupling timings of the M through BK clutches are identical with the corresponding timings of FIG. 14.

So long as the number of times of use of the image transfer units is small, the shifts of toner images ascribable to the ON/OFF of image transfer biases for different colors are not noticeable, as shown in FIG. 2. However, the shifts of toner images become noticeable as the above number of times increases, as shown in FIGS. 3 through 5.

In light of the above, as shown in FIG. 16, the illustrative embodiment sets the ON/OFF timings of image transfer biases outside of the image forming processes. More specifically, the image transfer bias for all colors are turned on at substantially the same time as the start of the M (most upstream side) image forming process and turned off at the same time as the OFF of the BK image transfer bias (most downstream side). In the illustrative embodiment, the biases for all colors are turned off in about 50 ms since the end of the BK image forming process.

As stated above, in the illustrative embodiment, the clutches and image transfer biases for all colors are turned on before the start of the image forming process for the first color and then turned off after the end of the image forming process for the last color. Therefore, even when the image transfer units are repeatedly used a number of times, the slip condition remains the same throughout the consecutive nips between the drums and the belt, so that the belt can move stably. This successfully reduces color shifts ascribable to the variation of the belt surface position. Further, software for controlling the image transfer biases and devices for turning on and turning off the biases are simplified, reducing designer's load and device cost.

While the first and second embodiments both are implemented as a tandem, multifunction full-color copier using the direct belt transfer system, they are similarly practicable with an indirect image transfer system using an intermediate image transfer belt known in the art.

As stated above, in the first and second embodiments, the member (P, 60) to which toner images are to be transferred is conveyed via the consecutive image carriers 11M through 11BK. At the same time, toner images are sequentially transferred from the image carriers 11M through 11BK to the member (P, 60) one above the other. This allows a plurality of toner images of different colors to be transferred to the member (P, 60) at far higher speed than when use is made of a single image carrier. The slip condition remains substantially the same throughout the consecutive nips between the image carriers and the member (P, 60), so that the relative speed of each image carrier and member (P, 60) varies little. Consequently, the illustrative embodiments described above reduce the shifts of the toner images relative to each other on the member (P, 60).

Third Embodiment

Figure 17:
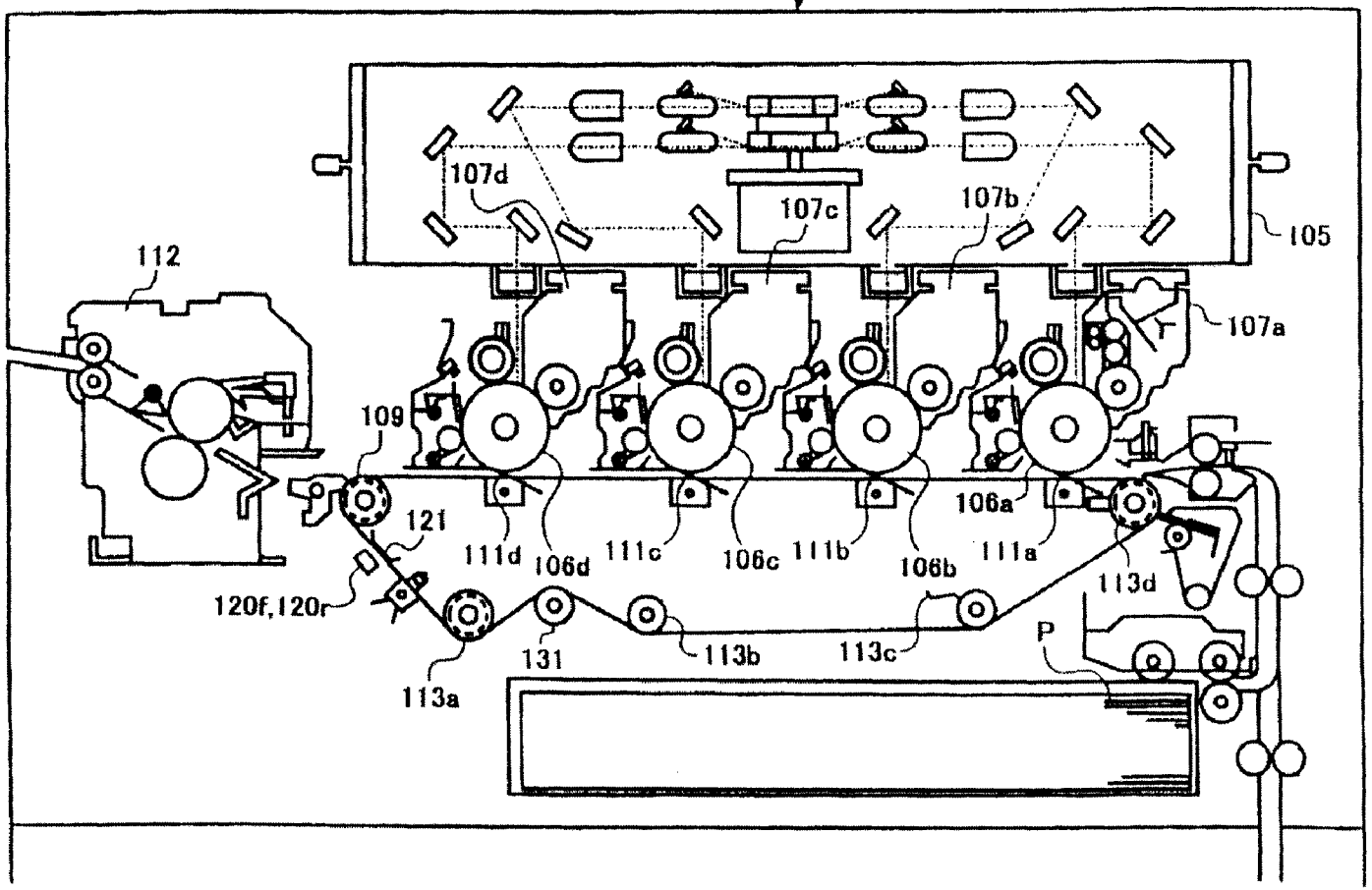
FIG. 17 is a view showing a second embodiment of the image forming apparatus in accordance with the present invention.

Reference will be made to FIG. 17 for describing a third embodiment of the present invention implemented as a printer PRT. As shown, the printer PRT includes an optical writing unit or exposing unit 105 that receives BK, Y, C and M image data from an image processing section not shown. The writing unit 105 scans an M, a C, a Y and a BK drum 106*a*, 106*b*, 106*c* and 106*d* with laser beams modulated in accordance with the M, C, Y and BK image data, respectively, thereby forming an M, a C, a Y and a BK latent image. Developing units 107*a*, 107*b*, 107*c* and 107*d* respectively develop the M, C, Y and BK latent images with M, C, Y and BK toners, thereby producing an M, a C, a Y and a BK toner image on the drums 106*a*, 106*b*, 106*c* and 106*d*, respectively.

A sheet P fed from a cassette 108 is conveyed by a belt 110 included in a belt unit. While the belt 110 conveys the sheet P via consecutive image transfer positions where the drums 106*a* through 106*d* respectively face image transfer units

111*a* through 111*d*, the image transfer units 111*a* through 111*d* respectively transfer the M through BK toner images from the drums 106*a* through 106*d* to the sheet P one above the other. As a result, a full-color toner image is completed on the sheet P. Subsequently, a fixing unit 112 fixes the full-color toner image on the sheet P. Finally, the sheet P carrying the fixed full-color toner image is driven out of the printer PRT.

The belt 110 is implemented as a light-transmitting endless belt passed over a drive roller 109, a tension roller 131, and driven rollers 113*a*, 113*b*, 113*c* and 113*d*.

The printer PRT includes mark set forming means for obviating the color shift of the toner images sequentially transferred to the sheet P. The mark set forming means is configured to form a plurality of mark sets each including the four different colors M through BK within the circumferential length of the belt 110. More specifically, the mark set forming means is configured such that a test pattern is written on the front and rear ends of the drums 6*a* through 6*d*, as seen in the axial direction, then developed, and then transferred to the belt 110.

Figure 18:
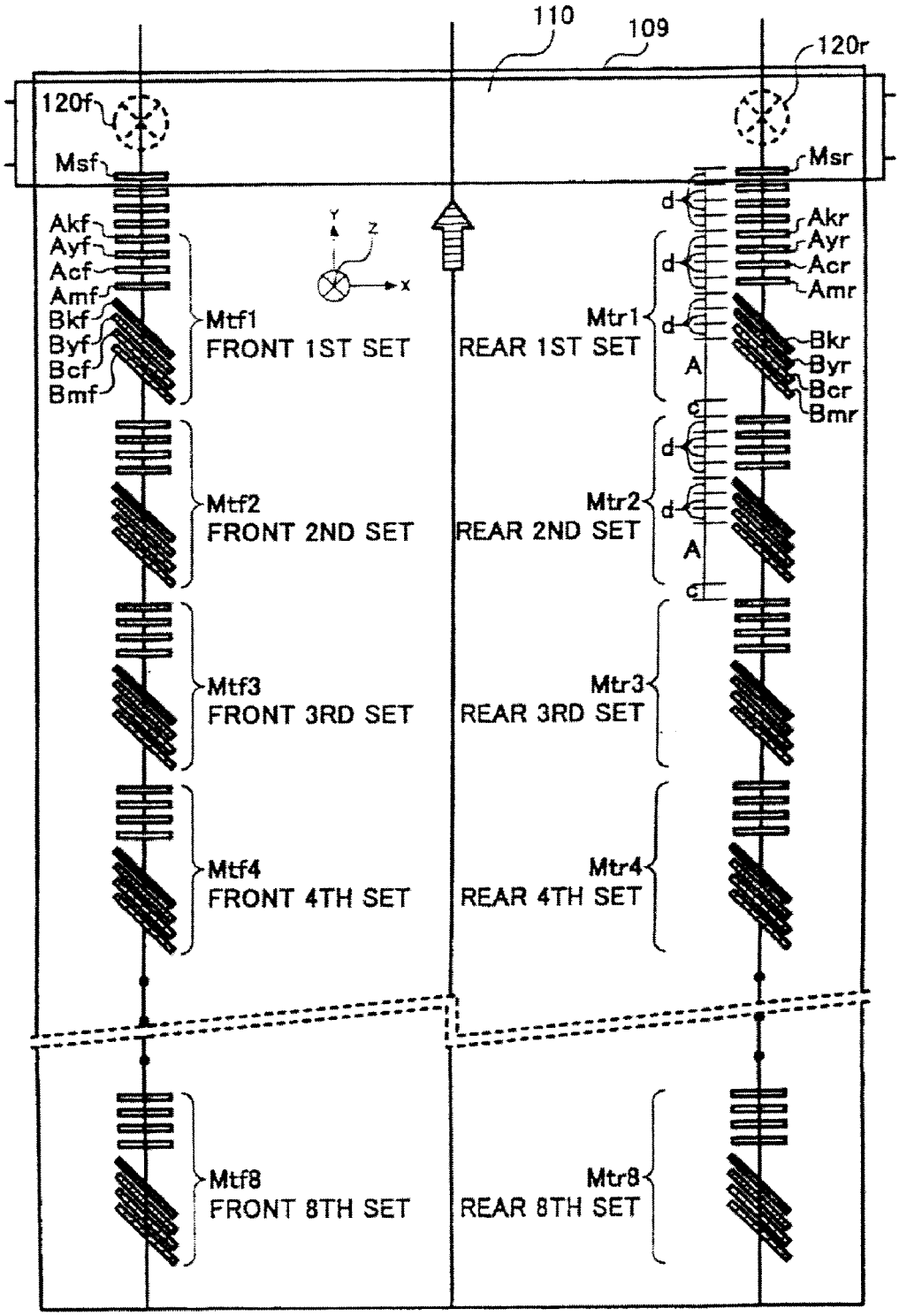
FIG. 18 shows a specific arrangement of mark sets particular to the second embodiment.

FIG. 18 shows a specific test pattern made up of a plurality of mark sets. As shown in FIGS. 17 and 18, reflection type photosensors 120*f* and 120*r*, which constitute mark sensing means, sense the test pattern transferred to the belt 110. Subsequently, shift calculating means, not shown, calculates the mean shift of the marks of the same color included in the mark sets from a reference position. The mean shifts of the marks are used to calculate the positional shifts of the writing positions assigned to the writing unit 105 relative to the drums 106*a* through 106*d*, inclination, magnification and so forth. Thereafter, shift correcting means corrects the write timings of the writing unit 105 relative to the drums 106*a* through 106*d* in such a manner as to obviate color shifts, thereby correcting the shifts of the toner images of different colors to be transferred to the sheet P.

As shown in FIG. 18, the test pattern formed on the belt 110 is made up of black start marks Msf and Msr heading the test pattern and eight consecutive mark sets following the start marks Msf and Msr after four pitches 4.times.d. Also, the test pattern is sequentially formed within the circumferential length of the belt 110 at a constant set pitch of 7.times.d+A+c. In the specific test pattern of FIG. 18, the set pitch corresponds to three-fourths of the circumferential length of each of the drums 106*a* through 106*d*. Eight sets including the start marks, i.e., sixty-five marks in total are formed within the circumferential length of the belt 110.

The first front mark set includes a perpendicular mark group parallel to the main scanning direction x, or the widthwise direction of the belt 110, and an oblique mark group inclined by 45.degree. relative to the main scanning direction x. The perpendicular mark group is made up of a first or BK perpendicular mark Akf, a second or Y perpendicular mark Ayf, a third or C perpendicular mark Acf, and a fourth or M perpendicular mark Amf. Likewise, the oblique mark group is made up of a first or BK oblique mark Bkf, a second or Y oblique mark Byf, a third or C oblique mark Bcf, and a fourth or M perpendicular mark Bmf. The second to eighth mark sets are identical in content with the first mark set each. A test pattern identical with the front test pattern is formed at the rear edge portion of the belt 110. In FIG. 18, suffixes f and r denote front and rear, respectively.

However, the load to act on the drive roller 109 is heavier during the conveyance of the sheet P effected by the belt 110 than during the correction of the positional shifts, so that the belt 110 and drive roller 109 are apt to slip on each other during the conveyance. Such a slip brings about a color shift on the sheet P despite that the correcting means has brought the images of different colors into register with respect to the belt 110.

The above problem can be solved by specific examples of the illustrative embodiment to be described hereinafter. In the specific examples, structural elements identical with those of the printer PRT shown in FIG. 17 are designated by identical reference numerals and will not be described specifically in order to avoid redundancy.

EXAMPLE 1

Figure 19:
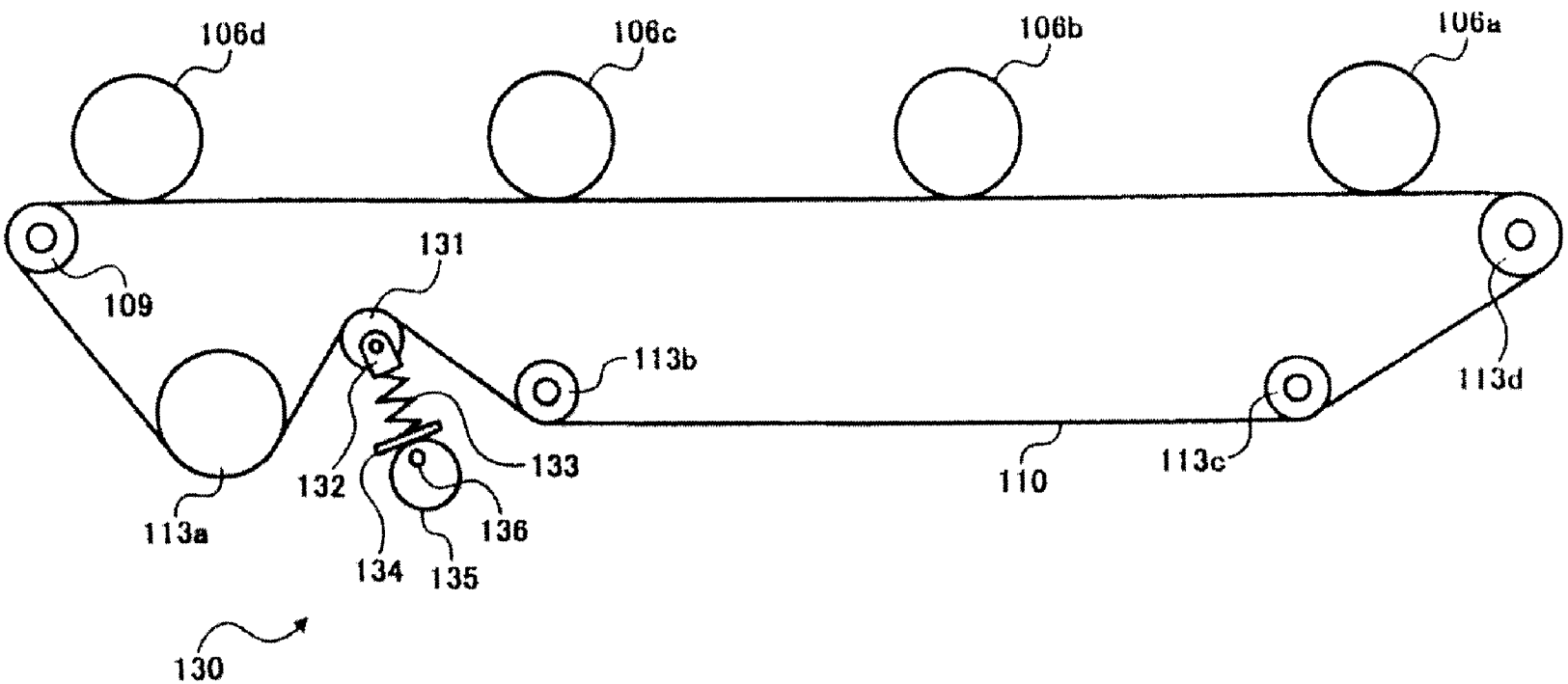
FIG. 19 shows part of Example 1 of the second embodiment.
Figure 20:
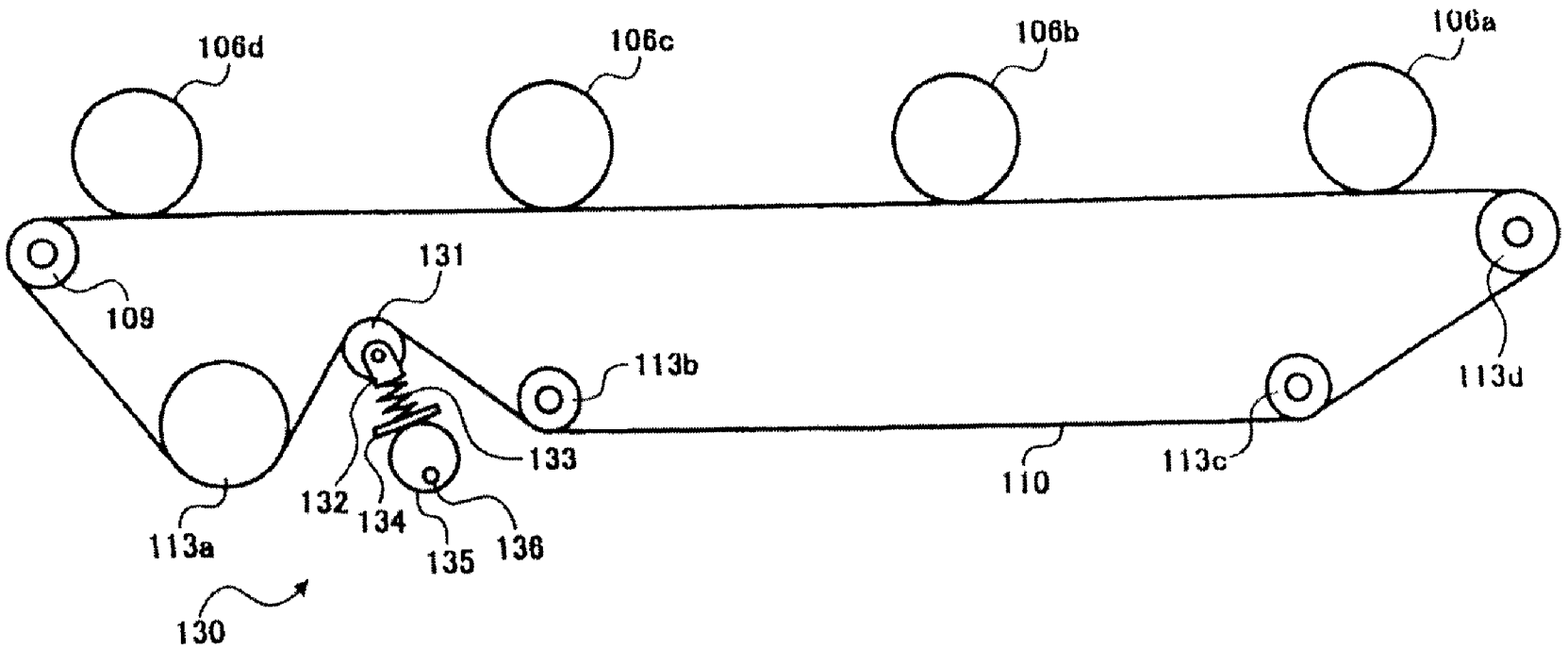
FIG. 20 demonstrates the operation of tension varying means included in Example 1.

As shown in FIGS. 19 and 20, Example 1 includes tension varying means 130 in addition to the structural elements of the printer PRT described above. The tension varying means 130 varies tension to act on the belt 110 during the conveyance of the sheet P. The tension varying means 130 varies pressure to be exerted by a tension roller or tension applying means 131 on the belt 110.

More specifically, the tension roller 13 is rotatably supported by a bearing 132 slidably mounted on the frame of the belt unit not shown. A spring 133 constantly biases the bearing 132 toward the outer surface of the belt 110. The bearing 132 therefore causes the tension roller 131 to press the belt 110 with preselected pressure, thereby exerting preselected tension on the belt 110. The other end of the spring 133 remote from the bearing 132 is retained by a seat-like cam follower 134.

An eccentric cam 35 is mounted on an eccentric shaft 136 and has a cam edge contacting the cam follower 134. A cam drive mechanism, not shown, causes the eccentric cam 135 to rotate about the eccentric shaft 136. In the cam drive mechanism, the output shaft of a stepping motor, for example, is directly connected to the eccentric shaft 136. When a preselected number of pulses are input to the stepping motor, the motor causes the eccentric cam 135 to rotate to a preselected angular position via the eccentric cam 136. By varying the angle of rotation of the eccentric cam 136, it is possible to vary the position of the cam follower 134, i.e., the position of the end of the spring 133 remote from the bearing 132 and therefore the length of the spring 133. Consequently, the pressure of the tension roller 131 acting on the belt 110 and therefore the tension acting on the belt 110 is varied.

FIG. 19 shows the eccentric cam 136 in a position where the tension acting on the belt 110 is minimum (minimum tension Tmin hereinafter). FIG. 20 shows the eccentric cam 136 in a position where the above tension is maximum (maximum tension Tmax hereinafter). The minimum tension Tmin is selected such that the belt 110 and drive roller 109 do not slip on each other during shift correction. On the other hand, the maximum tension Tmax is selected such that the belt 110 and drive roller 109 do not slip on each other during the conveyance of the sheet P by the belt 110. In Example 1, as for the belt 110 formed of PVDF, the minimum and maximum tensions are selected to fall between 1.5 N/cm and 2 N/cm and between 2.5 N/cm and 3 N/cm, respectively.

Figure 21:
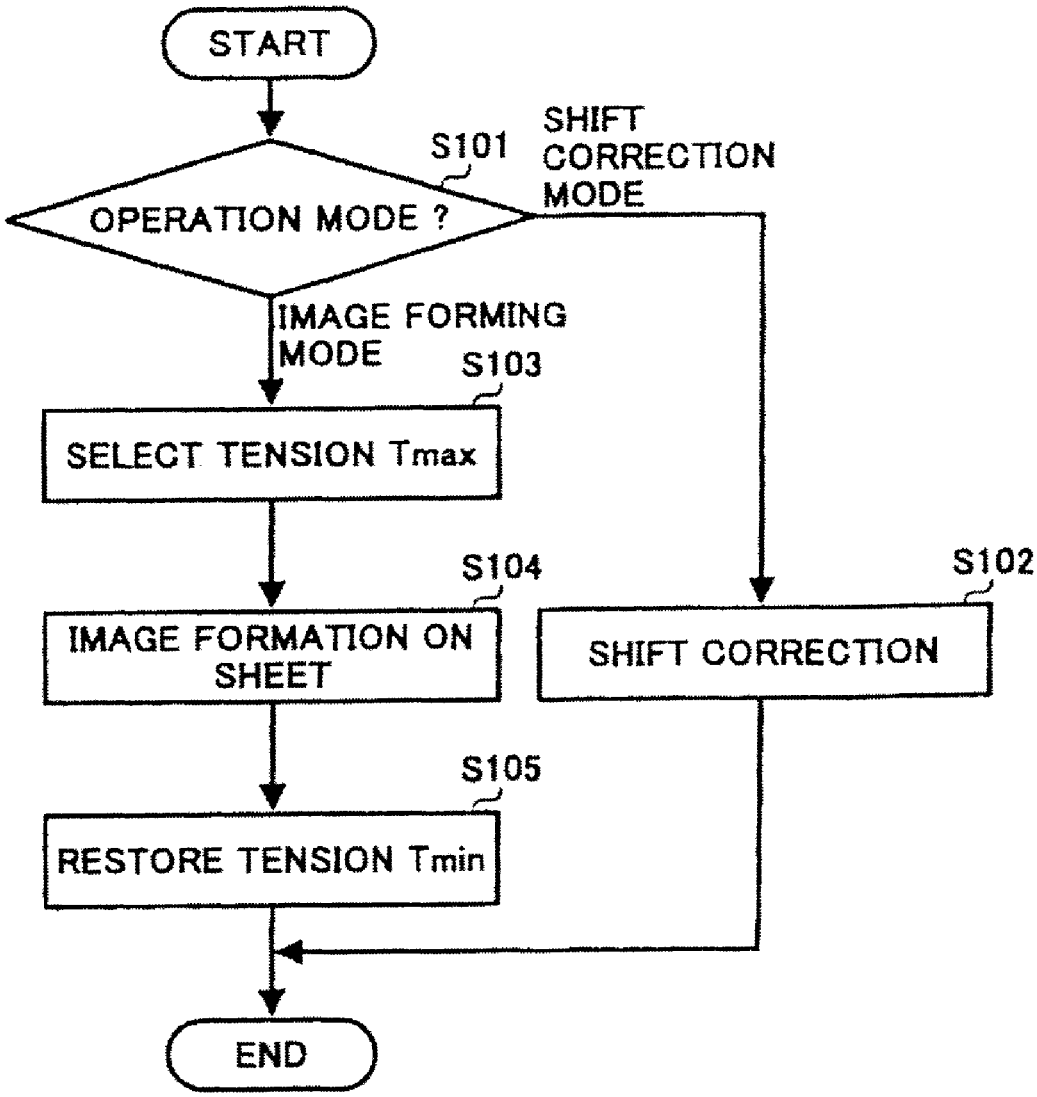
FIG. 21 is a flowchart demonstrating a specific operation of Example 1.

FIG. 21 shows a specific procedure available with Example 1 for varying the tension of the belt 110 with the tension varying means 130. As shown, whether an operation mode to start is an image forming mode, or sheet conveying mode, or whether it is a shift correcting mode is determined (step S101). If the operation mode is the shift correcting mode, then shift correction is executed (step S102). This is the end of the procedure. On the other hand, if the operation mode is the image forming mode, then the eccentric cam 135 is rotated to the position of FIG. 20 to thereby vary the tension acting on the belt 110 to the maximum tension Tmax (step S103), so that the belt 110 and drive roller 109 are prevented from slipping on each other. This is followed by a step S104 of forming an image on the sheet P. After the step S104, the eccentric cam 135 is rotated to the position of FIG. 19 for thereby restoring the minimum tension Tmin to act on the belt 110 (step S105)

EXAMPLE 2

Example 2 is identical with Example 1 except for the following. In Example 2, the tension applying means 130 varies the tension to act on the belt 110 in accordance with the thickness of the sheet P to be conveyed by the belt 110 for the following reason. The load acting on the drive roller 109 during the conveyance of the sheet P (image forming mode) is not always constant, but varies in accordance with the thickness of the sheet P. Therefore, during sheet conveyance, the above load becomes heavy and is apt to cause the belt 110 and drive roller 109 to slip on each other.

Figure 22:
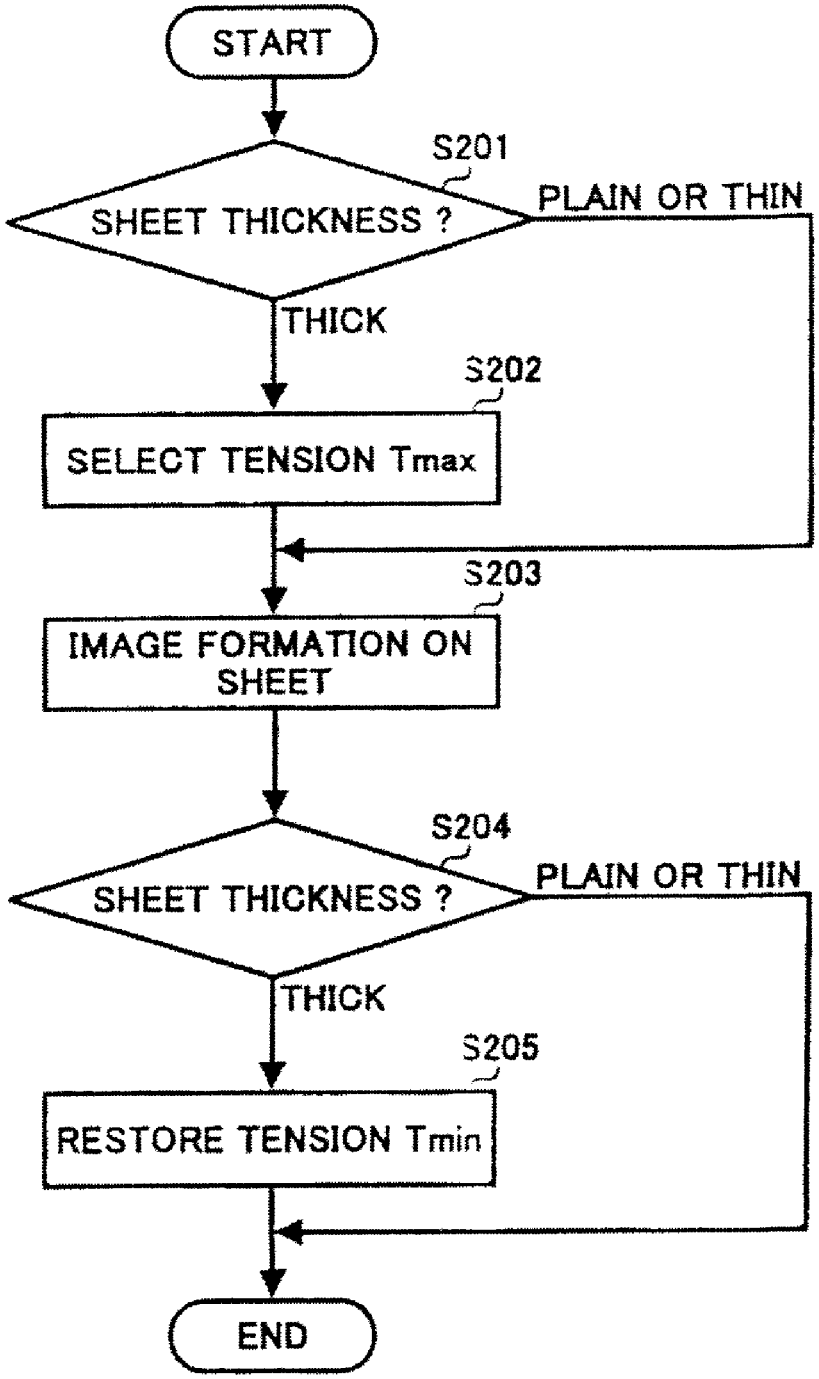
FIG. 22 is a flowchart demonstrating a specific operation of Example 2.

FIG. 22 demonstrates a specific procedure available with Example 2 for varying the tension of the belt 110 with the tension varying means 130. As shown, whether the sheet P is a thick sheet or whether it is a plain or a thin sheet is determined on the basis of thickness information (step S201). The thickness information may be input by the operator of the printer on the operation panel or may be implemented as information selected by the operator of a personal computer on a printer driver picture. Alternatively, a sensor responsive to the thickness of the sheet P may be positioned on the sheet conveyance path. In Example 2, the sheet P is determined to be a thick sheet when weight belongs to the 110 kg class or above on the basis of whether or not the operator has selected "thick" on the operation panel.

If the sheet P is a thick sheet, as determined in the step S201, then the eccentric cam 135 is rotated to the position of FIG. 20 in order to set up the maximum tension Tmax to act on the belt 110 (step S202), so that the belt 110 and drive roller 109 do not slip on each other during the conveyance of the thick sheet P. The step S202 is followed by a step S203 of forming an images on the sheet P. Subsequently, whether or not the sheet P is a thick sheet is again determined (step S204). If the answer of the step S204 is positive, then the eccentric cam 135 is rotated to the position of FIG. 19. Thereafter, the minimum tension Tmin to act on the belt 110 is restored (step S205). This is the end of the procedure. If the sheet P is not a thick sheet, but is a plain or a thin sheet, as determined in the step S201 or 204, then the procedure directly ends, skipping the step S202 or 205.

EXAMPLE 3

Example 3 differs from Examples 1 and 2 in that the tension varying means 130 varies the tension of the belt 110 in accordance with the size of the sheet P to be conveyed by the belt 110 for the following reason. The load acting on the drive roller 109 during the conveyance of the sheet P (image forming mode) is not always constant, but varies in accordance with the size of the sheet P. More specifically, even during usual printing, the length of the sheet P to be conveyed from the sheet feeding section to the image transferring section and from the image transferring section to the fixing section varies in accordance with the sheet size, so that the load on the drive roller 109 is dependent on the sheet size. For example, when the sheet P being conveyed is of size A3 or above, the load on the drive roller 109 increases and is apt to cause the belt 110 and drive roller 109 to slip on each other.

Figure 23:
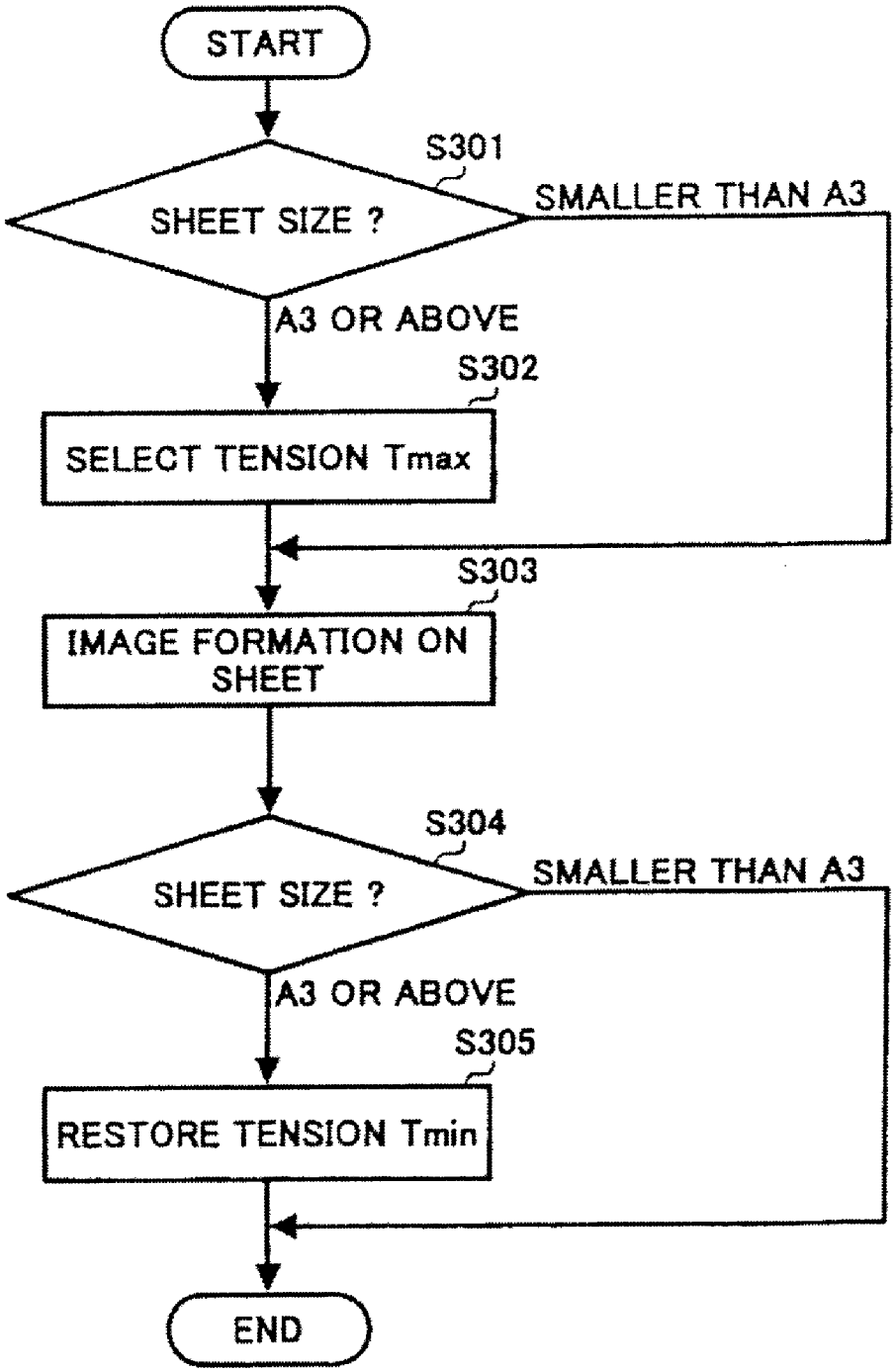
FIG. 23 is a flowchart demonstrating a specific operation of Example 3.

FIG. 23 shows a specific procedure available with Example 3 for varying the tension of the belt 110 with the tension varying means 130. As shown, whether or not the sheet P to be conveyed is of size A3 or above is determined in accordance with size information (step S301). The size information may be input by the operator of the printer on the operation panel or may be implemented as information selected by the operator of a computer on a printer driver picture. Alternatively, a sensor, not shown, responsive to the size of sheets stacked on a sheet tray may be used. In Example 3, a sheet size of A3 or above is determined to a large size while use is made of the information output from the above sensor.

If the sheet P is of large size, as determined in the step S301, then the eccentric cam 135 is rotated to the position of FIG. 20 for thereby causing the maximum tension Tmax to act on the belt 110 (step S302). In Example 3, the maximum tension Tmax is selected such that the belt 110 and drive roller 109 do not slip on each other during the formation of an image on the sheet P of size A3 or above. The step S302 is followed by a step S303 of forming an image on the sheet P. Subsequently, whether or not the sheet P of large size is again determined (step S304). If the answer of the step S304 is positive, then the eccentric cam 135 is rotated to the position of FIG. 19. Thereafter, the tension to act on the belt 110 is restored to the minimum tension Tmin (step S305). This is the end of the procedure. On the other hand, if the answer of the step S301 or 304 is negative, then the procedure directly ends, skipping the step S302 or S305.

EXAMPLE 4

Example 4 differs from Examples 1 through 3 in that the tension varying means 130 varies the tension of the belt 110 in a plurality of steps for the following reason. To prevent the belt 10 and drive roller 109 from slipping on each other, the tension to act on the belt 110 maybe increased. However, maintaining the tension high at all times causes the belt 110 to be permanently stretched due to the creep of the material of the belt 110, thereby making the tension lower than the target tension. Further, such high tension causes the belt 110 to curl.

Figure 24A:
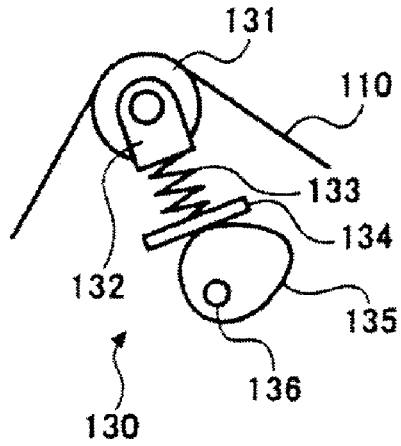
FIGS. 24A through 24C are views showing three different tension conditions particular to Example 4.
Figure 24B:
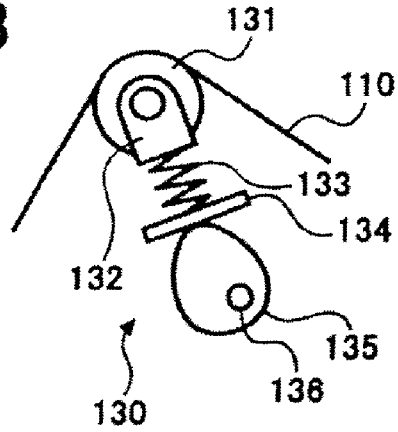
Figure 24C:
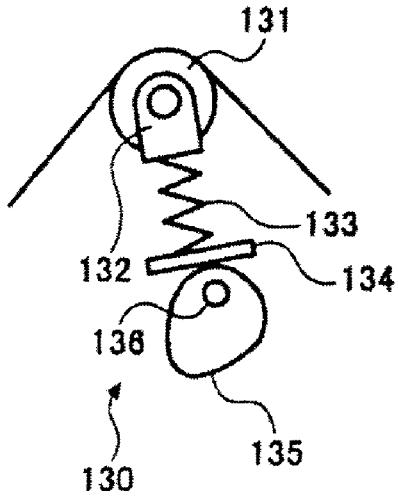

FIGS. 24A through 24C each show a particular position at which the eccentric cam 135 of the tension varying means 130 is brought to a stop. Such stop positions of the eccentric cam 135 each cause a particular degree of tension to act on the belt 10 via the tension roller 131. In FIG. 24A, tension T1 is assigned to the image forming mode using a plain or a thin sheet while, in FIG. 24B, tension T2 is assigned to the image forming mode using a thick sheet. Further, in FIG. 24C, tension TO is assigned to the shift correcting mode.

Figure 25:
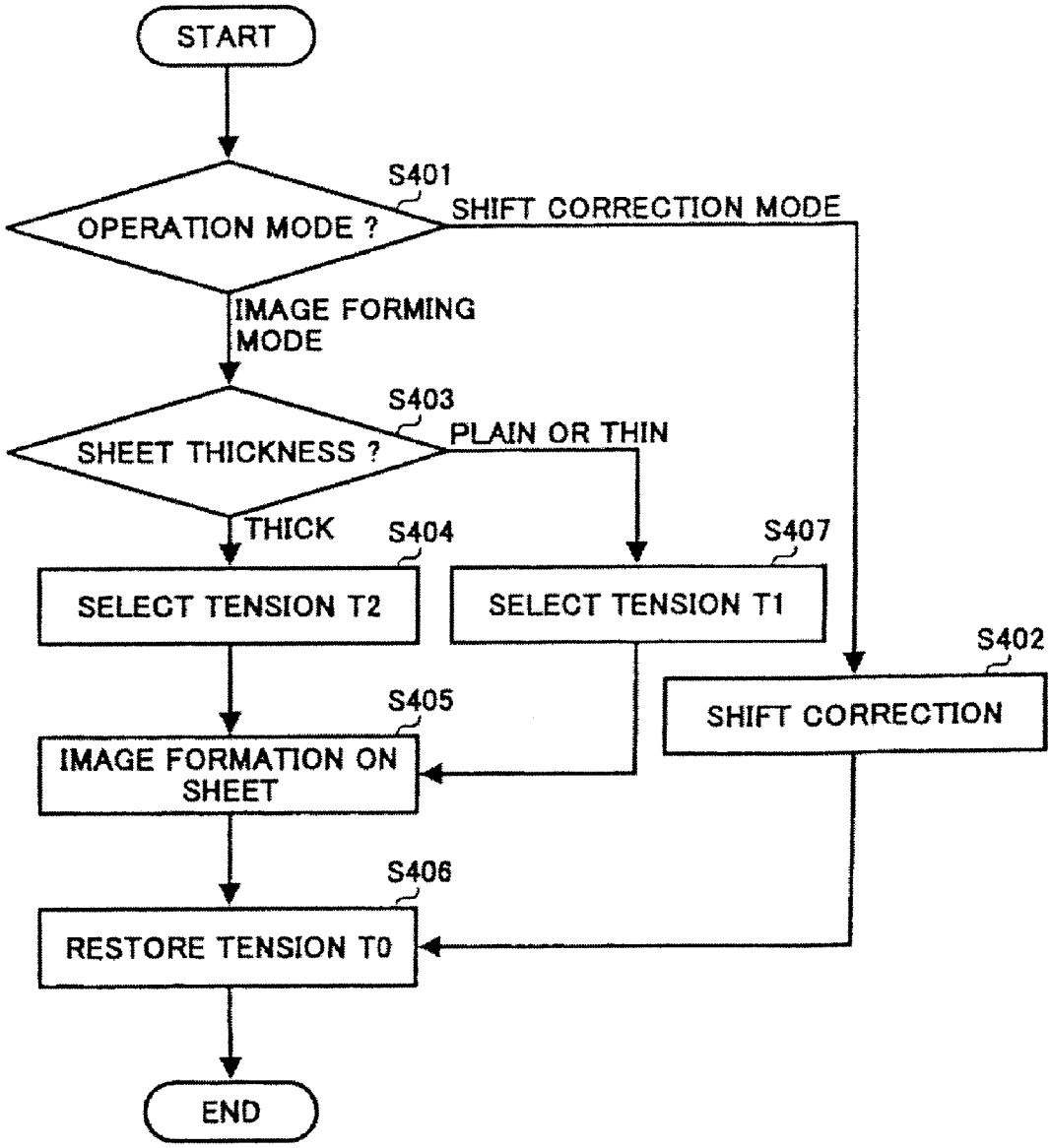
FIG. 25 is a flowchart demonstrating a specific operation of Example 4.

FIG. 25 demonstrates a specific procedure available with Example 4 for varying the tension of the belt 110 with the tension varying means 130. As shown, whether the operation mode to start is the image forming mode or sheet conveying mode or whether it is the shift correcting mode (step S401). If the operation mode is the shift correcting mode, then shift correction is executed (step S402) This is the end of the procedure.

If the operation mode to start is the image forming mode, as determined in the step S401, then whether the sheet P to be conveyed by the belt 110 is a thick sheet or whether it is a plain or a thin sheet is determined (step S403). If the sheet P is a thick sheet, then the eccentric cam 135 is rotated to the position of FIG. 24B to thereby set up the tension T2 (step S404). In Example 4, the tension T2 is selected such that the belt 110 and drive roller 109 do not slip on each other during image formation using a thick sheet. The step S404 is followed by a step S405 of forming an image on the thick sheet P. After the step S405, the eccentric cam 135 is rotated to the position of FIG. 24C to thereby set up the tension T0 (step S406). This is the end of the procedure.

If the sheet P is a plain or a thin sheet, as determined in the step S403, then the eccentric cam 135 is rotated to the position of FIG. 24A to set up the tension T1 (step S407). The step S407 is also followed by the step S405. Subsequently, the eccentric cam 135 is rotated to the position 24C to setup the tension T0 (step S406). This is the end of the procedure. The tension T0 is selected such that the belt 110 is free from permanent stretch ascribable to the creep of its material as well as from curl.

As stated above, in Example 1, when the belt 110 conveys the sheet P, it moves stably without any slip and insures accurate register of images of different colors on the sheet P. In Examples 2 and 3, even when the sheet P is thick, the belt 110 is free from heavy load and can therefore move stably without any slip. In Example 4, the belt 110 is free from permanent stretch ascribable to the creep of the material as well as from curl.

In summary, it will be seen that the present invention provides an image forming apparatus capable of transferring images of different colors to a sheet in accurate register and thereby insuring high image quality.

Various modifications will become possible for those skilled in the art after receiving the teachings of the present disclosure without departing from the scope thereof.

The invention claimed is:

1. An image forming apparatus comprising:

a plurality of image carriers arranged side by side in a preselected direction;

a plurality of developing means each for forming a toner image on a particular one of said plurality of image carriers;

drive means for driving in the preselected direction, a member to which toner images are to be sequentially transferred from said plurality of image carriers, the toner images transferred one above the other;

a plurality of developing drive means for driving each of said developing means; and a plurality of image transferring means each for transferring a toner image from a particular one of said plurality of image carriers to said member, said plurality of developing drive means are configured to all stop being driven at a same time after said member reaches a last one of said plurality of image carriers and an image transfer timing has ended.

2. The apparatus as claimed in claim 1, wherein application of transfer bias by each of the image transferring means is configured to be stopped at a same time.

3. An image forming apparatus comprising;

a plurality of image carriers arranged side by side in a preselected direction;

a plurality of developing rollers each for forming a toner image on a particular one of said plurality of image carriers;

drive mechanism configured to drive in the preselected direction, a member to which toner images are to be sequentially transferred from said plurality of image carriers, the toner images transferred one above the other;

a plurality of developing roller drive mechanisms configured to drive each of said developing rollers; and a plurality of image transferring mechanisms each configured to transfer a toner image from a particular one of said plurality of image carriers to said member, said plurality of developing roller drive mechanisms are configured to all stop being driven at a same time after said member reaches a last one of said plurality of image carriers and an image transfer timing has ended.

4. The image forming apparatus as claimed in claim 3, wherein application of transfer bias by each of the image transferring mechanisms is stopped at a same time.

5. A method for operating an image forming apparatus including, a plurality of image carriers arranged side by side in a preselected direction, a plurality of developing rollers each for forming a toner image on a particular one of said plurality of image carriers, a drive mechanism for driving in the preselected direction a member to which toner images are to be sequentially transferred from said plurality of image carriers, the toner images transferred one above the other, a plurality of developing roller drive mechanisms configured to drive each of said developing rollers, and a plurality of image transferring mechanisms, each for transferring a toner image from a particular one of said plurality of image carriers to the member, the method comprising:

driving the plurality of developing roller drive mechanisms; and stopping, at a same time, the plurality of developing rollers from being driven after the member reaches a last one of said plurality of image carriers and an image transfer timing has ended.

6. The method of claim 5, further comprising:

stopping at a same time, a transfer bias of the transfer mechanisms.

* * * * *